US011662084B2

(12) United States Patent
Cohen

(10) Patent No.: US 11,662,084 B2
(45) Date of Patent: May 30, 2023

(54) FLANGELESS TRIM

(71) Applicant: Brandon Cohen, Vernon, CA (US)

(72) Inventor: Brandon Cohen, Vernon, CA (US)

(73) Assignee: AMP Plus, Inc., Vernon, CA (US)

( * ) Notice: Subject to any disclaimer, the term of this patent is extended or adjusted under 35 U.S.C. 154(b) by 0 days.

(21) Appl. No.: 17/486,845

(22) Filed: Sep. 27, 2021

(65) Prior Publication Data

US 2023/0100581 A1 Mar. 30, 2023

(51) Int. Cl.

| | |
|---|---|
| ***F21V 21/04*** | (2006.01) |
| ***F21V 17/16*** | (2006.01) |
| ***F21V 7/04*** | (2006.01) |
| ***F21S 8/02*** | (2006.01) |

(52) U.S. Cl.

CPC ..... *F21V 21/049* (2013.01); *F21S 8/02* (2013.01); *F21S 8/026* (2013.01); *F21V 7/041* (2013.01); *F21V 17/16* (2013.01); *F21V 21/04* (2013.01); *F21V 21/041* (2013.01); *F21V 21/042* (2013.01); *F21V 21/043* (2013.01); *F21V 21/044* (2013.01); *F21V 21/045* (2013.01);

(Continued)

(58) Field of Classification Search

CPC ..... F21V 21/043; F21V 21/046; F21V 7/041; F21V 21/04; F21V 20/041; F21V 21/042; F21V 21/044; F21V 21/045; F21V 21/047; F21V 21/048; F21V 21/049

See application file for complete search history.

(56) References Cited

U.S. PATENT DOCUMENTS 5,931,432 A * 8/1999 Herold ..... F21V 21/04 362/365
10,125,958 B1 * 11/2018 Wronski ..... F21V 21/047
2017/0009963 A1 * 1/2017 Germain ..... F21V 21/04

(Continued)

FOREIGN PATENT DOCUMENTS

ES 2505415 A1 * 10/2014
JP 2014216161 A * 11/2014

(Continued)

OTHER PUBLICATIONS

Machine Translation of KR 100735128 B1 retrieved from the FIT database of PE2E search. (Year: 2022).*

(Continued)

*Primary Examiner* — Colin J Cattanach
(74) *Attorney, Agent, or Firm* — Eric Kelly

(57) ABSTRACT

A reflector and of a holding-plate slidingly attach to each other to form a flangeless trim assembly. The reflector may be removably attached to a spackle-frame. The spackle-frame may be installed within ceiling drywall around a hole for a downlight. The holding-plate may be attached to a lighting module. In a default resting configuration, a top of the reflector butts up against a bottom of the holding-plate because springs push these two parts towards each other. When an opposing force is applied that is greater than the spring's force, then a variable gap is formed between the reflector and the holding-plate, but while the reflector and the holding-plate are still attached to each other. This gap may be used by human finger(s) to both disengage the reflector from the spackle-frame and to pull down the reflector, the holding-plate, and the lighting module from the spackle-frame—all without tools.

20 Claims, 35 Drawing Sheets

(52) U.S. Cl.
CPC ..... *F21V 21/046* (2013.01); *F21V 21/047* (2013.01); *F21V 21/048* (2013.01)

(56) References Cited

U.S. PATENT DOCUMENTS

| | | | | |
|---|---|---|---|---|
| 2018/0216809 | A1* | 8/2018 | Cohen | F21V 21/26 |
| 2018/0224095 | A1* | 8/2018 | Cohen | F21V 21/04 |
| 2018/0372283 | A1* | 12/2018 | Zeng | F21S 8/026 |
| 2019/0360666 | A1* | 11/2019 | Bowen | F21V 7/0066 |
| 2020/0378581 | A1* | 12/2020 | Cheng | F21V 17/16 |
| 2021/0003269 | A1* | 1/2021 | Wang | F21V 15/01 |
| 2022/0010916 | A1* | 1/2022 | Magruder | F16M 13/02 |

FOREIGN PATENT DOCUMENTS

| | | | |
|---|---|---|---|
| KR | 100735128 | B1 * | 7/2007 |
| KR | 1320897 | B1 * | 10/2013 |
| KR | 20140043220 | A * | 4/2014 |

OTHER PUBLICATIONS

Machine Translation of KR 1320897 B1 retrieved from the FIT database of PE2E search. (Year: 2022).*

Machine Translation of JP 2014216161 A retrieved from the FIT database of PE2E search. (Year: 2022).*

Machine Translation of KR 20140043220 A retrieved from the FIT database of PE2E search. (Year: 2022).*

Machine Translation of ES 2505415 A1 retrieved from the FIT database of PE2E search. (Year: 2022).*

Nora Lighting NIO-TLSUCTION suction cup to assist with removing trimless reflector from finished ceiling. https://noralighting.com/product/nio-tlsuction/ (last visited on Sep. 21, 2021).

DMF Lighting OneFrame Flangeless Trim DRD2TRJDSWHFL Installation. https://vimeo.com/169758683 (last visited on Sep. 21, 2021).

WAC Lighting, Aether 3.5: Trimless Downlight Round https://www.waclighting.com/product/aether-3-5-5/ (last visited on Sep. 21, 2021).

Tech Lighting, flangeless trims, and flangeless installation http://www.element-lighting.com/Products/Details/ENTRA-3-LED-Adjustable-Downlight (last visited on Sep. 21, 2021).

Creative Systems Lighting, round trimless (p. 2) and square trimless (p. 4) https://cdn.hvlgroup.com/csl/pdf/line-drawing/A3-4_linedwg.pdf (last visited on Sep. 21, 2021)).

Creative Systems Lighting, Acrobat 3in Adjustable Reflector Round Trimless Trim https://csllighting.com/Product/A3-4RWH (last visited Sep. 21, 2021).

Fusion Lighting by Elite Lighting, round trimless and square trimless https://media.iuseelite.com/specsheet2/er3-led-ic.pdf (last visited Sep. 21, 2021).

* cited by examiner

FLANGELESS TRIM

TECHNICAL FIELD OF THE INVENTION

The present invention relates in general to downlight trim assemblies and more specifically to flangeless downlight trim assemblies that may comprise reflectors that may be removably attached or detached to spackle-frames without tools and just using human finger(s); and/or wherein those reflectors may be attached other components such as holding-plates and/or lighting modules.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

Downlight trim has often traditionally included a flange component, wherein once this flanged trim is installed in a given ceiling, from below that ceiling, the flange may be visible, as well as underside portions of a reflector, and underside portions of the light module's lens. See e.g., FIG. 1D.

However, there may be reasons to have downlight trim without a flange, such that from below it appears there is no boundary (e.g., the flange) between where the ceiling ends and the reflector/trim begins. So, in a flangeless downlight trim scenario, from below all that one sees is the ceiling's underside portions of a reflector, and underside portions of the light module's lens, but not the traditional flange component which is absent. This is accomplished by replacing the traditional flange component with a spackle-frame. The spackle-frame is typically screwed into the ceiling's underside and the disc portions of the spackle-frame are spackled over and painted, so that the end result in a finished ceiling underside that seamlessly transitions to the reflector/trim, but without any visible flange.

However, with such flangeless downlight trims, a problem can arise in how to remove the reflector/trim and/or the given light module that is located above the reflector/trim. Because in the installed flangeless downlight trims there are no exposed surfaces that one can purchase on to pull down the reflector/trim and/or the associated light module. In the installed flangeless downlight trims scenarios, all that is typically present from the ceiling's underside is a smooth surface of the reflector's underside and the bottom of the lens.

One prior art solution to this problem has been to use a suction cup to attach to the smooth reflector surface and/or to the lens underside.

Another prior art solution has been to create a reflector that uses opposing spring-loaded ball-bearings to removably attach to the spackle-frame and to not have the above located lighting module be attached to that reflector. This prior art solution allows this reflector to be removed from the spackle-frame without tools, just human fingers. This prior art approach is shown in FIG. 1A through FIG. 1C. However, this prior art solution leads to a secondary problem of how to remove lighting module that is located above that removed reflector. Under this prior art approach that removal of the lighting module may require use of tools.

There is a need in the art for a flangeless trim that may be installed or removed from a spackle-frame without using tools, with only using human fingers; and wherein installation or removal of that flangeless trim also installs or removes the associated lighting module, and still without using tools, with only using human fingers, because a portion of that flangeless trim may be attached to the lighting module.

It is to these ends that the present invention has been developed.

BRIEF SUMMARY OF THE INVENTION

To minimize the limitations in the prior art, and to minimize other limitations that will be apparent upon reading and understanding the present specification, embodiments of the present invention describe downlight reflectors, downlight flangeless trim, and/or lighting system that may comprise such downlight reflectors and/or downlight flangeless trim along with lighting modules.

In some embodiments, the downlight reflectors comprise structures (e.g., stepped protrusions with clips) for removable attachment to a spackle-frame. By disengaging the clips the reflector may be removed from the spackle-frame. To install (removably attach) the reflector to the spackle-frame, the reflector need only be pushed into the main-largest-central hole of the spackle-frame until the clips engage the spackle-frame.

In some embodiments, the downlight reflector may comprise different structures (e.g., shafted fasteners, springs, and various apertures) for attachment to a holding-plate; and the holding-plate may be configured to attach to a given lighting module. In a default or resting configuration, while the reflector is attached to the holding-plate, a bottom of the holding-plate may butt up against a top of the reflector, such that there is no gap between the holding-plate and the reflector. However, in a second configuration, still while the reflector is attached to the holding-plate, the reflector and the holding-plate may be separated from each other by a gap. This gap may be created and maintained without tools, aside from only human fingers. This gap may be formed and maintained by human fingers pushing the holding-plate (and/or attached lens) away from the reflector. Formation of this gap may permit a person to disengage clips of the reflector, to detach the reflector (with attached holding-plate) from the spackle-frame. Further, this gap may provide fingers with purchase to be able to pull down the reflector (with attached holding-plate [and/or with attached lighting module]) from the spackle-frame. Without this gap, there may be no structures for human fingers to find purchase to pull down the reflector (with attached holding-plate [and/or with attached lighting module]), as without this gap, there may be only the smooth underside surfaces of the reflector and the underside surface of lens.

It is an objective of the present invention to provide a downlight reflector that may be used in flangeless trim downlight scenarios.

It is another objective of the present invention to provide a downlight reflector that may be removably attached (detached) to a spackle-frame.

It is another objective of the present invention to provide a downlight reflector that may be removably attached (detached) to a spackle-frame without tools.

It is another objective of the present invention to provide a downlight reflector that may be removably attached (detached) to a spackle-frame with only using human fingers.

It is another objective of the present invention to provide a downlight reflector that may be attached to a holding-plate.

It is another objective of the present invention to provide a downlight reflector that may be attached to a holding-plate, wherein the holding-plate may be attached to a lighting module.

It is another objective of the present invention to provide a downlight reflector that while attached to a holding-plate, the downlight reflector may be separated from the holding-plate by a gap.

It is another objective of the present invention to provide a downlight reflector that while attached to a holding-plate, the downlight reflector may be separated from the holding-plate by a gap, wherein the gap may be variable in length/distance.

It is another objective of the present invention to provide a downlight reflector that while attached to a holding-plate, the downlight reflector may be separated from the holding-plate by a gap, wherein the gap may provide room/space for human fingers (without tools) to disengage clip(s) between the downlight reflector and a spackle-frame.

It is another objective of the present invention to provide a downlight reflector that while attached to a holding-plate, the downlight reflector may be separated from the holding-plate by a gap, wherein the gap may provide purchase for human fingers (without tools) to pull the downlight reflector, with attached holding-plate downwards and away from a spackle-frame.

It is another objective of the present invention to provide a downlight reflector that while attached to a holding-plate, the downlight reflector may be separated from the holding-plate by a gap, wherein the gap may provide purchase for human fingers (without tools) to pull the downlight reflector, with attached holding-plate, and with a lighting module that is attached to the holding-plate, downwards and away from a spackle-frame.

It is another objective of the present invention to provide a downlight reflector and a spackle-frame that may be used in flangeless trim downlight scenarios.

It is another objective of the present invention to provide a downlight reflector and a lighting module that may be used in flangeless trim downlight scenarios.

It is yet another objective of the present invention to provide a downlight reflector, a spackle-frame, and a lighting module that may be used in flangeless trim downlight scenarios.

These and other advantages and features of the present invention are described herein with specificity so as to make the present invention understandable to one of ordinary skill in the art, both with respect to how to practice the present invention and how to make the present invention.

BRIEF DESCRIPTION OF THE SEVERAL VIEWS OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

FIG. 1B is almost a side view.

FIG. 1C is almost a top view, i.e., more of a top view than a perspective view.

REFERENCE NUMERAL SCHEDULE

Figure 1A:
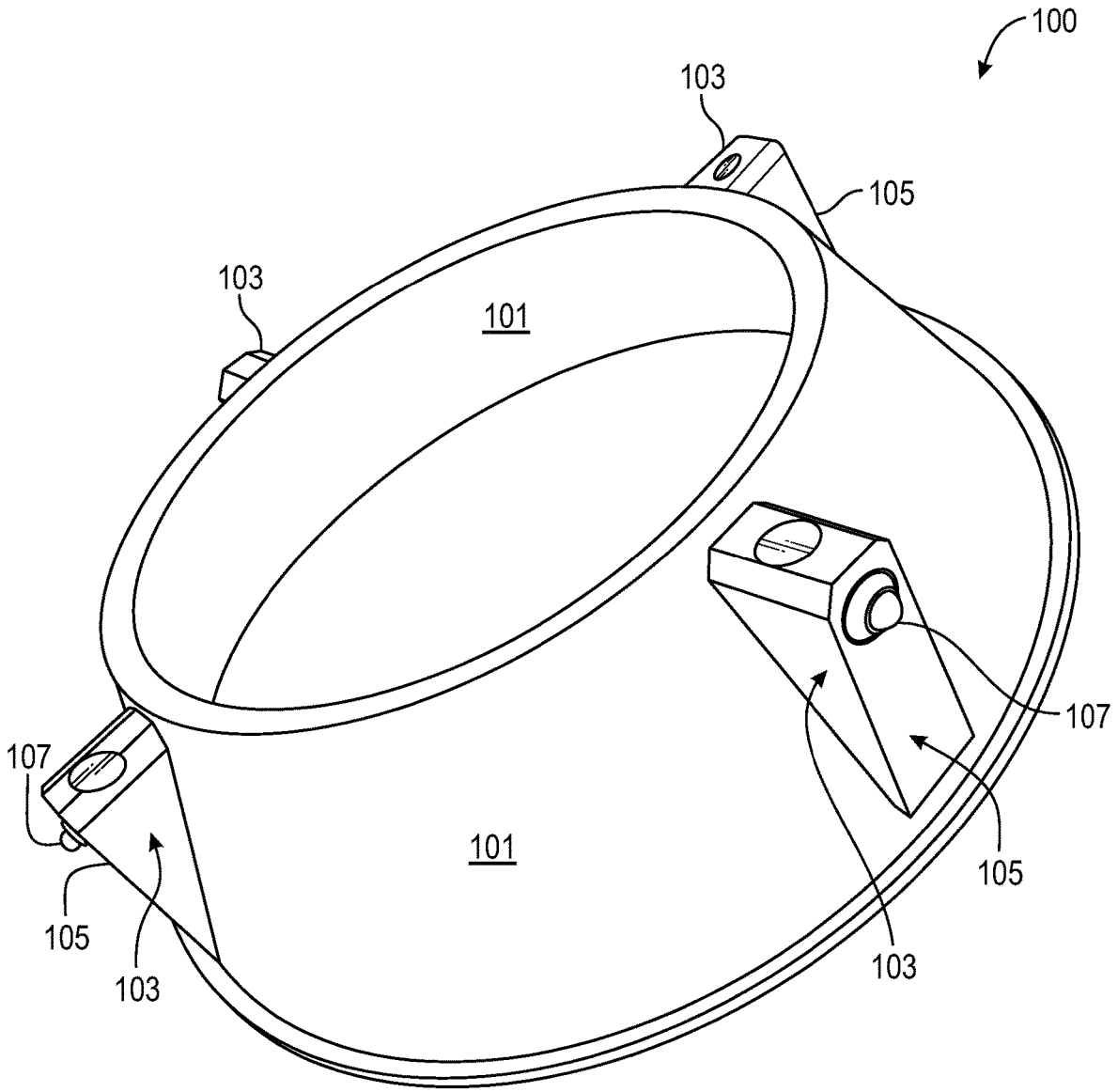
FIG. 1A (Prior Art)
FIG. 1A depicts a top perspective view of a prior art trim component/part.

100 prior art trim 100
101 conical side wall 101
103 protrusion 103 of side wall (four of them spaced 90 degrees apart)
105 non-stepped face 105
107 spring-loaded ball bearing 107 (at top of non-stepped face)
150 prior art flange trim 150
151 flange 151
153 ceiling 153
155 reflector 155
157 lens 157
200 flangeless trim assembly 200
201 spackle-frame 201
202 largest central hole 202
203 aperture 203
205 groove(s) 205
207 coupler 207
209 (cylindrical) side wall 209
211 top-opening 211
213 outside-diameter-of-side-wall 213
215 flange 215
223 reflector 223
225 (conical) side-wall 225
227 protrusion-of-side-wall (stepped-protrusion) 227
231 top-stepped-face 231
239 clip 239
241 holding-plate (mounting-plate) 241
243 (cylindrical) side wall 243
245 top-opening 245
247 aperture 247
249 rib 249
251 inside-ledge 251
253 flange 253
255 aperture 255
257 protrusion-of-flange 257
259 mechanical fastener 259
261 spring 261
321 trim 321
333 aperture 333
335 bottom-stepped-face 335
337 clip-receiver 337
401 smaller-top-opening 401
403 larger-bottom-opening 403
405 smaller-diameter 405
407 larger-diameter 407
500 lighting module assembly 500
501 heat sink module 501
503 driver cap 503
505 lens holder/lens 505
507 set-fastener 507
601 (variable) gap-between-plate-holder-and-reflector 601
801 finger(s) (human) 801
803 hand/palm (human) 803
901 bottom surface 901 (of ceiling)
1000 reflector-and-light-module-subassembly 1000
1001 lighting module 1001
1003 driver-cap-and/or-heat-sink 1003
1005 side-wall 1005
1007 flanged-base 1007
1009 receiving-aperture 1009
1010 indenture 1010
1011 fin(s) 1011
1013 top 1013
1015 cable 1015
1017 lens 1017

DETAILED DESCRIPTION OF THE INVENTION

Note, directional terms such as "up," "down," "above," below," "vertical," horizontal," and/or the like are generally used herein in the context of ceilings with downlights. For example, in this context, a given ceiling is generally located vertically above a given floor; wherein the given floor is often in a horizontal plane that is perpendicular to the vertical direction. For example, bottom views noted herein (such as, but not limited to, FIG. 2C-FIG. 2E, FIG. 2G, and FIG. 9) are generally with respect to how the given assembly would look from below the given ceiling, when that given assembly may be at least partially installed in that given ceiling. As such, top views of ceiling installed assemblies would not be visible from below the ceiling.

Note, the term "common longitudinal/axial center" of flangeless trim assembly 200, of lighting module assembly 500, and/or the like refers to an imaginary line that runs through an axial/longitudinal center of flangeless trim assembly 200, of lighting module assembly 500, and/or the like; and in a direction that is parallel (or substantially parallel) with a vertical direction that runs from top to bottom (or bottom to top).

In the following discussion that addresses a number of embodiments and applications of the present invention, reference is made to the accompanying drawings that form a part thereof, where depictions are made, by way of illustration, of specific embodiments in which the invention may be practiced. It is to be understood that other embodiments may be utilized and changes may be made without departing from the scope of the invention.

Figure 1B:
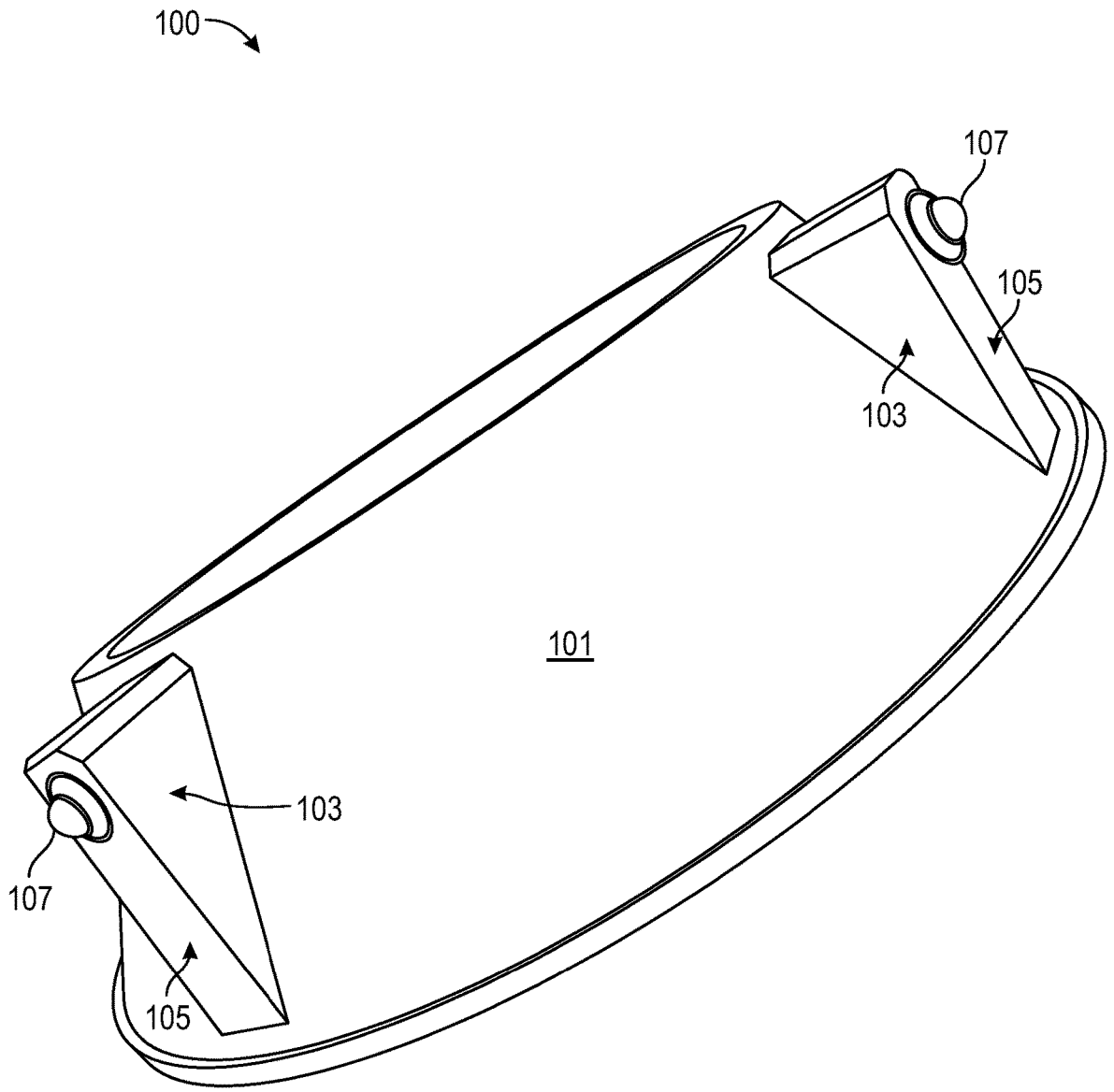
FIG. 1B (Prior Art)
FIG. 1B depicts another, different, top perspective view of the prior art trim component/part of FIG. 1A.
Figure 1C:
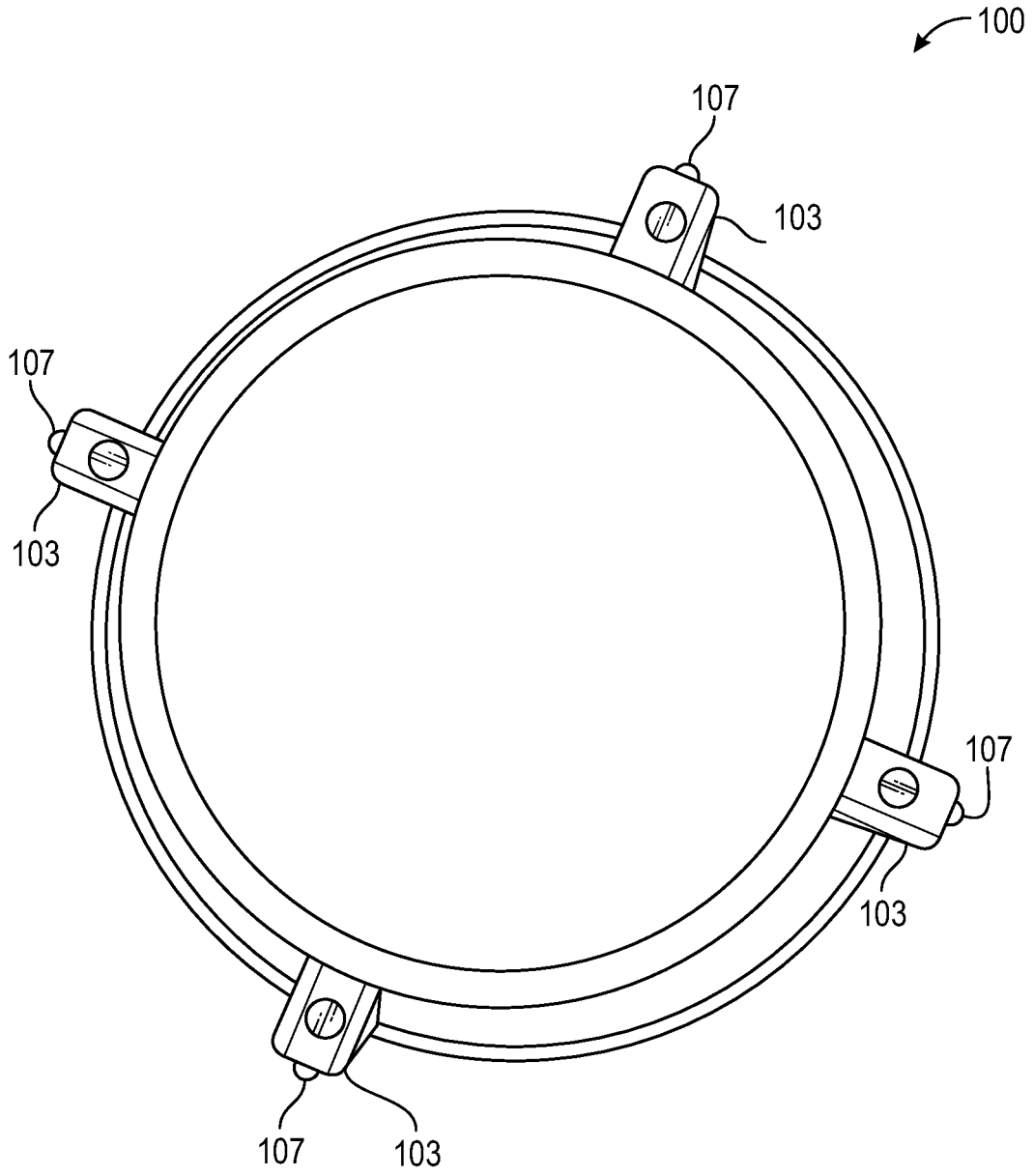
FIG. 1C (Prior Art)
FIG. 1C depicts yet another different top perspective view of the prior art trim component/part of FIG. 1A.

FIG. 1A depicts a top perspective view of a prior art trim 100 component/part. FIG. 1B depicts another, different, top perspective view of prior art trim 100 component/part. FIG. 1B is almost a side view. FIG. 1C depicts yet another different top perspective view of prior art trim 100 component/part. FIG. 1C is almost a top view, i.e., more of a top view than a perspective view. Prior art trim 100 has a conical side wall 101 and is open on prior art trim 100 top and bottom. Protruding from four different regions of conical side wall 101 are protrusions 103. The four protrusions 103 of conical side wall 101 are spaced about ninety (90) degrees apart with respect to a common longitudinal/axial center of prior art trim 100. Note, each top of protrusion 103 has a circular indenture, likely a remnant from injection molding, but otherwise each top of protrusion 103 is entirely free of any hole/aperture. Note, each top of protrusion 103 is below an uppermost top of conical side wall 101. Each protrusion 103 has a flat non-stepped face 105 that runs in a direction that is substantially parallel with common longitudinal/axial center of prior art trim 100. Near a top of each non-stepped face 105 is a spring-loaded ball bearing 107. These spring loaded ball bearings 107 are used to attach prior art trim 100 to a given spackle frame. An outside diameter of two opposing spring loaded ball bearings 107 is greater than an inside diameter of the main/largest central hole of the spackle frame. Prior art trim 100 is also a reflector and functions as a reflector. When prior art trim 100 is installed into the spackle frame and the spackle frame is installed into a ceiling, the lighting module that will/is residing above the uppermost top of conical side wall 101 is not directly attached to prior art trim 100.

Figure 1D:
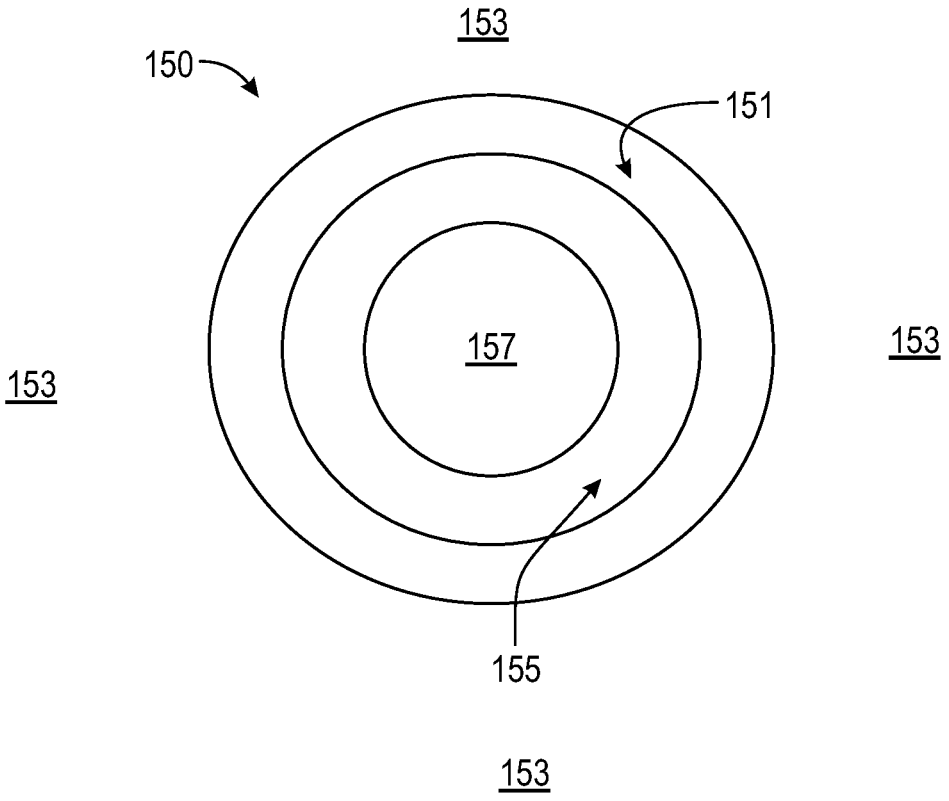
FIG. 1D (PRIOR ART)
FIG. 1D is a bottom view of a prior art example of a flanged trim installed into the bottom of a given ceiling.

FIG. 1D is a bottom view of a prior art example of a flanged trim 150 installed into the bottom of a given ceiling 153. Downlight trim has often traditionally included a flange 151 component, wherein once this flanged trim 150 is installed in a given ceiling 153, from below the flange 151 may be visible, as well as underside portions of a reflector 155, and underside portions of the light module's lens 157 that may be installed above ceiling 153 and installed above flange 151. In contrast, embodiments of the present invention are directed to flangeless trim, i.e., downlight trim (and associated components) that are without (free of) such flanges as prior art flange 151.

Figure 2A:
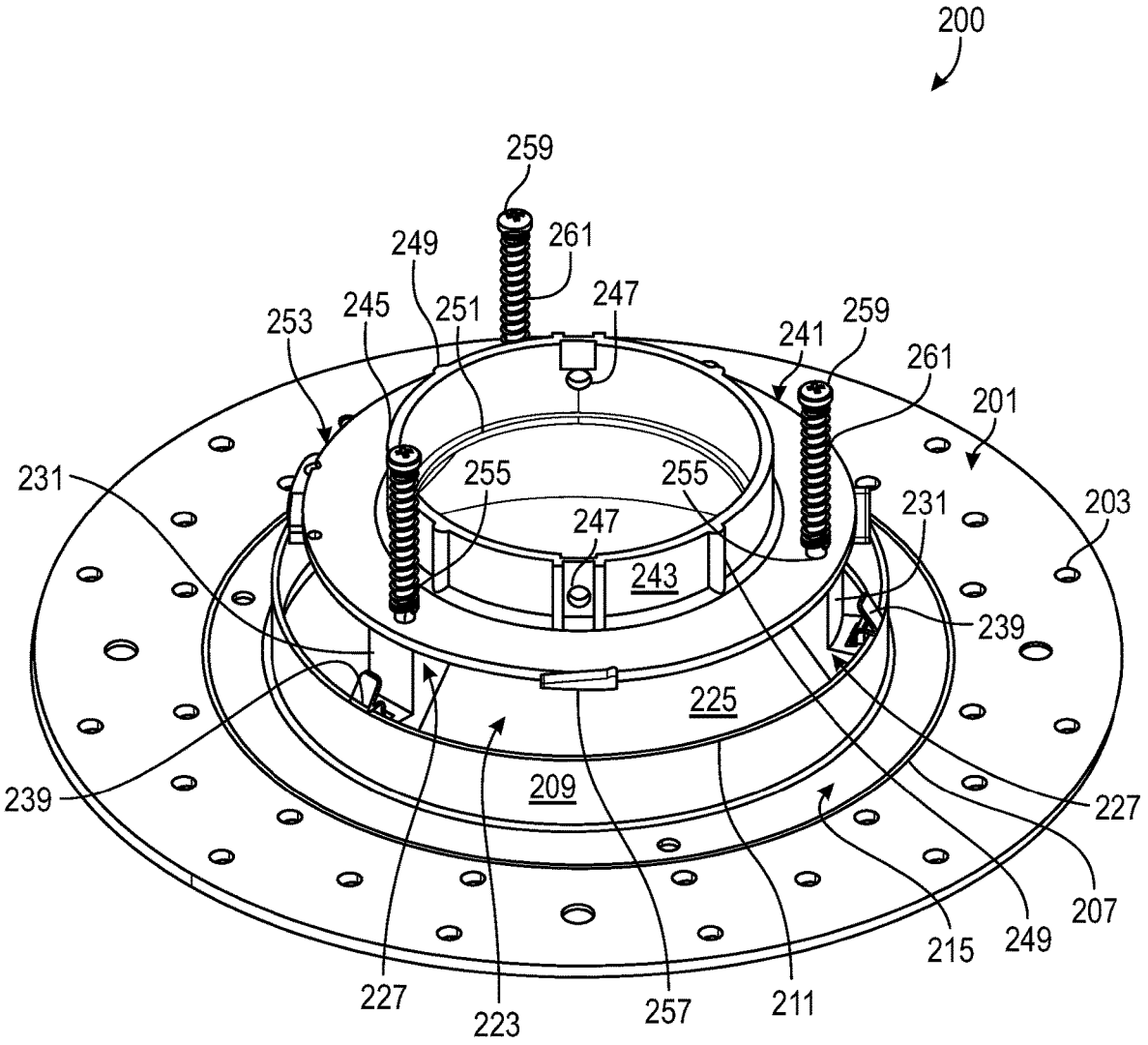
FIG. 2A depicts a top perspective of a flangeless trim assembly.
Figure 2B:
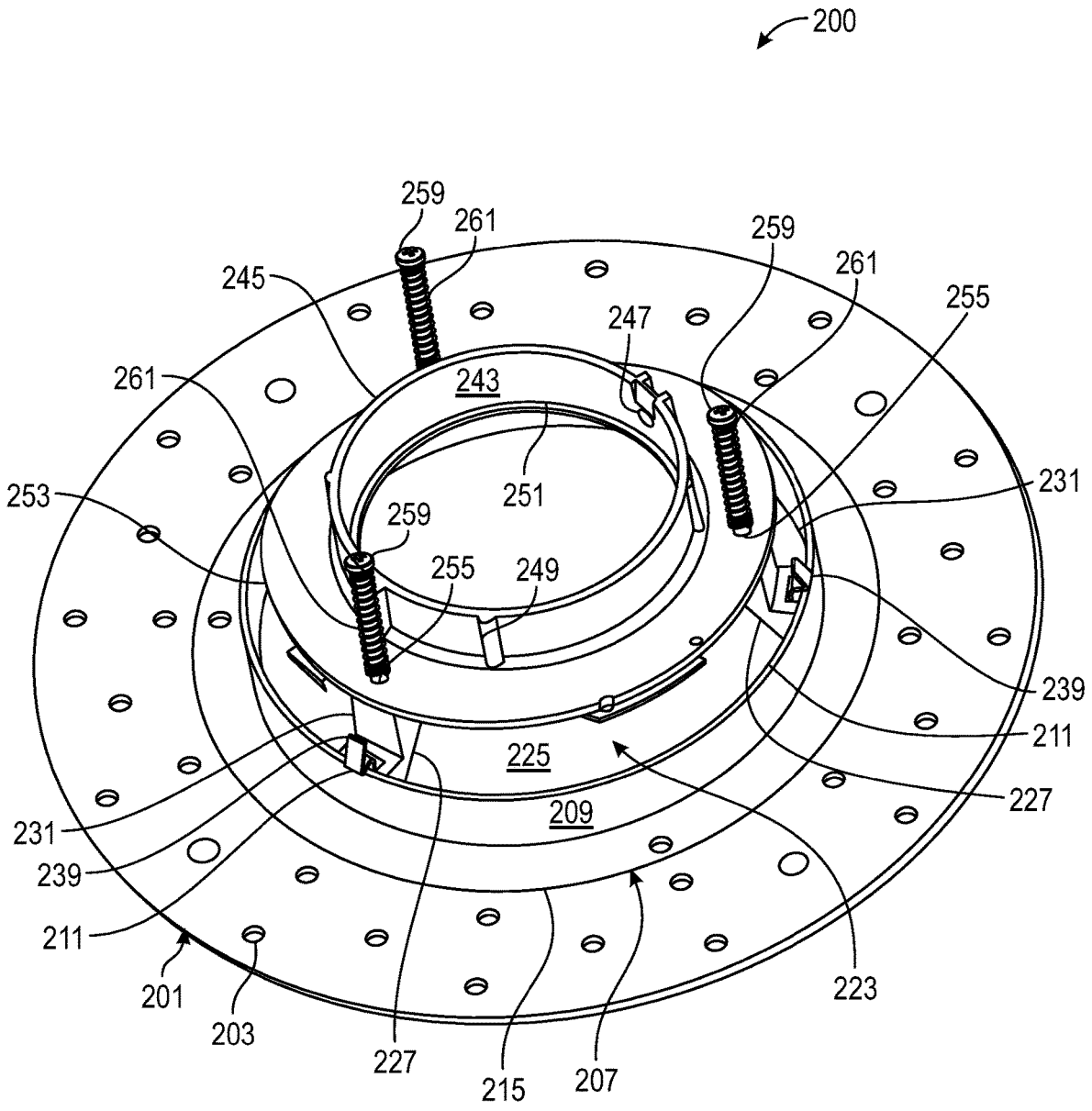
FIG. 2B depicts a slightly different top perspective of the flangeless trim assembly of FIG. 2A.

FIG. 2A depicts a top perspective of a flangeless trim assembly 200. FIG. 2B depicts a slightly different top perspective of flangeless trim assembly 200. In some embodiments, flangeless trim assembly 200 may be configured for installing a reflector 223, with an attached lighting module assembly 500, behind ceiling drywall, but without a traditional flange member that may be visible from the underside of the ceiling, hence the term, "flangeless." Traditional ceiling lighting modules may the traditional flange member that overlaps the underside of the ceiling and that circumscribes the hole where the reflector and lighting module are located above the ceiling. In flangeless trim assembly 200, this traditional flange member is absent and is replaced by spackle-frame 201. In some embodiments, flangeless trim assembly 200 may comprise: spackle-frame 201 and a trim 321. Note, reference numeral 321 for trim 321 is shown in FIG. 3B. In some embodiments, trim 321 may comprise: reflector 223, a holding-plate 241, and at least one fastener 259.

Continuing discussing FIG. 2A and FIG. 2B, in some embodiments, spackle-frame 201 may be configured to be attached to an underside of a given ceiling (e.g., drywall) and mounted to that ceiling underside with screws and with spackle. In some embodiments, such spackle may be used to cover over holes and/or defects in the drywall with a plaster or a plaster like compound. In some embodiments, such spackle may also be referred to as mud, joint compound, plaster, and/or the like. In some embodiments, such spackle is often a white color. In some embodiments, spackle-frame 201 may be mostly/substantially a disc member with one largest central hole 202 that may be hollow. In some embodiments, surrounding largest central hole 202 may be the disc member and the disc member may comprise a plurality of apertures (holes) 203. In some embodiments, diameters of apertures 203 may be smaller than a diameter of largest central hole 202. In some embodiments, aperture 203 may be a through hole that may pass entirely through the disc member portion of spackle-frame 201. In some embodiments, apertures 203 may be configured to receive spackle and/or a screw. In some embodiments, apertures 203 are used to attach spackle-frame 201 to the ceiling's underside with screws and spackle. Once spackle-frame 201 is attached to the ceiling's underside, the disc member portion and apertures 203 of spackle-frame 201 should no longer be visible and only largest central hole 202 of spackle-frame 201 should be visible. Spackle-frame 201 is intended to be permanently installed to the ceiling's underside, using screws and spackle.

Continuing discussing FIG. 2A and FIG. 2B, in some embodiments, spackle-frame 201 may comprise at least one coupler 207. In some embodiments, coupler 207 may be attached to the disc member and/or to largest central hole 202. In some embodiments, coupler 207 may be configured to facilitate removable attachment of reflector 223 and/or trim 321 (and/or what may be attached to reflector 223 and/or trim 321, such as lighting module assembly 500) to spackle-frame 201. In some embodiments, coupler 207 may be attached to a top portion of the disc member of spackle-frame 201. In some embodiments, coupler 207 may also be a disc member, but with a raised (cylindrical) side wall 209 and with a surrounding flange 215. In some embodiments, flange 215 of coupler 207 may be attached to the top of the disc member of spackle-frame 201. In some embodiments, side wall 209 may extend upwards away from the flange 215 and away from the disc member of spackle-frame 201, a fixed and finite distance, ending at top-opening 211. In some embodiments, side wall 209 may be substantially cylindrical in shape. In some embodiments, side wall 209 may provide structural regions of attachment for the removable attachment of reflector 223 and/or trim 321 (and/or what may be attached to reflector 223 and/or trim 321, such as lighting module assembly 500) to spackle-frame 201. In some embodiments, top-opening 211 may be an opening at a top of coupler 207 and/or at a top of side wall 209. In some embodiments, top-opening 211 may be disposed away from flange 215 and/or away from the disc member of spackle-frame 201. In some embodiments, the inside diameter of largest central hole 202 and an inside diameter of top-opening 211 may be the same or similar. In some embodiments, the inside diameter of largest central hole 202 and/or the inside diameter of top-opening 211 may size to fit outside diameters: of reflector 223, holding-plate 241, and/or of lighting module assembly 500.

Continuing discussing FIG. 2A and FIG. 2B, in some embodiments, reflector 223 may be a reflector. In some embodiments, reflector 223 may be configured to function as a reflector. In some embodiments, reflector 223 may be configured for use in/with a ceiling downlight assembly or the like. In some embodiments, reflector 223 may have a substantially/mostly conical frustum shape and/or a truncated cone shape—that may be hollow. In some embodiments, reflector 223 may comprise a (conical) side-wall 225. In some embodiments, side-wall 225 may be substantially/mostly conical frustum in shape and/or form a truncated cone in shape—that may be hollow. In some embodiments, reflector 223 may be open at a top and open at a bottom of reflector 223. In some embodiments, reflector 223 may comprise both a top hole (e.g., smaller-top-opening 401 noted in FIG. 4A) and an oppositely disposed bottom hole (e.g., larger-bottom-opening 403 noted in FIG. 4A); wherein the top hole and the bottom hole are separated from each other by side-wall 209. In some embodiments, reflector 223 may be hollow. In some embodiments, the top hole of reflector 223 may be smaller in diameter than the bottom hole of reflector 223. In some embodiments, a shape of side-wall 225 may be substantially/mostly conical, conical frustum, truncated cone, and/or the like. In some embodiments, side-wall 225 may circumscribe a hollow volume. In some embodiments, an interior of side-wall 225 may be configured to function as a reflector. In some embodiments, the interior of side-wall 225 may be shiny and/or smooth.

Continuing discussing FIG. 2A and FIG. 2B, in some embodiments, side-wall 225 may comprise at least two protrusions-of-side-wall 227. In some embodiments, "protrusions-of-side-wall 227" may also be referred to as "stepped-protrusion 227." In some embodiments, side-wall 225 may comprise three protrusions-of-side-wall 227 that are equally spaced apart/around side-wall 225. In some embodiments, side-wall 225 may comprise three protrusions-of-side-wall 227 that are spaced apart/around from each other by about 120 degrees (plus or minus five (5) degrees). In some embodiments, side-wall 225 may comprise four protrusions-of-side-wall 227 that are equally spaced apart/around side-wall 225. In some embodiments, side-wall 225 may comprise four protrusions-of-side-wall 227 that are spaced apart/around from each other by about ninety (90) degrees (plus or minus five (5) degrees). In some embodiments, each protrusion-of-side-wall 227 has a stepped-face comprised of a top-stepped-face 231 and a bottom-stepped-face 335.

Continuing discussing FIG. 2A and FIG. 2B, in some embodiments, each protrusion-of-side-wall 227 may comprise at least one clip 239. In some embodiments, each bottom-stepped-face 335 may comprise at least one clip 239. In some embodiments, each bottom-stepped-face 335 may be configured to receive and/or house the at least one clip 239. In some embodiments, clip 239 may be a spring clip (but not a helix/coiled spring) and/or a tension clip. In some embodiments, clip 239 may be configured to removably attach reflector 223 to side wall 209 of coupler 207.

Continuing discussing FIG. 2A and FIG. 2B, in some embodiments, holding-plate 241 may be configured to provide structure (e.g., aperture 247) for receiving attachment of lighting module assembly 500 and may also be configured to provide additional/different structure (e.g., aperture 255) for attaching holding-plate 241 to reflector 223. In some embodiments, "holding-plate 241" may also be referred to as "mounting-plate 241." In some embodiments, a shape of holding-plate 241 may be similar to a shape of coupler 207; however, holding-plate 241 may have smaller diameters than diameters of coupler 207. In some embodiments, holding-plate 241 may be attached to a top of reflector 223 using one or more fasteners 259 passing through aperture(s) 255 of flange 253 of holding-plate 241 and into aperture(s) 333 (shown in FIG. 3A and in FIG. 4A) of reflector 223. In some embodiments, holding-plate 241 may be a third disc member (different from the disc members of spackle-frame 201 and coupler 207), with a raised (cylindrical) side wall 243 and with a surrounding flange 253. In some embodiments, side wall 243 may extend upwards a fixed and finite distance from flange 253 and ending at top-opening 245 of side wall 243. In some embodiments, side wall 243 may be substantially/most cylindrical in shape; however, side wall 243 may comprise one or more vertically running rib(s) 249. In some embodiments, rib 249 may provide additional structural strength to side wall 243. In some embodiments, top-opening 245 may be define a substantially/mostly circular top opening to holding-plate 241.

Continuing discussing FIG. 2A and FIG. 2B, in some embodiments, side wall 243 may comprise at least one aperture 247. In some embodiments, side wall 243 may comprise at least two apertures 247. In some embodiments, side wall 243 may comprise two apertures 247 that are oppositely disposed from each other in side wall 243. In some embodiments, located adjacent on each side of aperture 247 may be two vertical parallel ribs 249. In some embodiments, aperture 247 may be a through hole, passing entirely through side wall 243. In some embodiments, aperture 247 may be configured to receive at least a portion of a set-fastener 507, for a purpose of securing lighting module assembly 500 to holding-plate 241.

Continuing discussing FIG. 2A and FIG. 2B, in some embodiments, flange 253 (of holding-plate 241) may comprise at least one aperture 255. In some embodiments, flange 253 may comprise a quantity of apertures 255 that matches a quantity of protrusions-of-side-wall 227 of reflector 223. In some embodiments, flange 253 may comprise one, two, three, or four apertures 255. In some embodiments, apertures 225 in flange 253 may be spaced equally apart from each other. In some embodiments, flange 253 may comprise three apertures 255 that may be spaced apart from each other by about 120 degrees (plus or minus five (5) degrees). In some embodiments, aperture 255 may be a through hole that may be pass entirely through flange 255. In some embodiments, aperture 255 may be configured to receive at least a portion of fastener 259 therein. In some embodiments, aperture(s) 255 may be how holding-plate 241 may be attached to the top of reflector 223, using fastener(s) 259.

Continuing discussing FIG. 2A and FIG. 2B, in some embodiments, an outside edge of flange 253 (of holding-plate 241) may comprise one or more protrusions-of-flange 257. In some embodiments, 257 may be configured for use in attaching various mating structures to holding-plate 241.

Continuing discussing FIG. 2A and FIG. 2B, in some embodiments, fastener 259 may be configured to attach holding-plate 241 to the top of reflector 223. In some embodiments, fastener 259 may be a mechanical fastener. In some embodiments, fastener 259 may be a screw and/or a bolt. In some embodiments, fastener 259 may comprise a head at one terminal end of fastener 259. In some embodiments, the head of fastener 259 may be located above a shaft of fastener 259. In some embodiments, the shaft of fastener 259 may not be threaded. In some embodiments, only a terminal end portion of the shaft of fastener 259, disposed away from the head, may be threaded. In some embodiments, the terminal end that is opposing the head of fastener 259 may be threaded. In some embodiments, the shaft portion(s) of a given mechanical fastener 259 may be configured to pass through aperture 255 (of flange 253) and/or through receiving-aperture 1009 (of flanged-base 1007). See also, FIG. 3A and FIG. 3B and FIG. 10A.

Continuing discussing FIG. 2A and FIG. 2B, in some embodiments, a quantity of fasteners 259 may match a quantity of protrusions-of-side-wall 227 and/or apertures 255. In some embodiments, trim 321 may comprise at least one fastener 259. In some embodiments, trim 321 may comprise one, two, three, or four fasteners 259. In some embodiments, flangeless trim assembly 200 may comprise at least one fastener 259. In some embodiments, flangeless trim assembly 200 may comprise one, two, three, or four fasteners 259.

Continuing discussing FIG. 2A and FIG. 2B, in some embodiments, trim 321 may comprise at least one spring 261. In some embodiments, spring 261 may be a helical/coiled spring. In some embodiments, spring 261 may be configured to be fitted around a shaft portion of fastener 259. In some embodiments, spring 261 may be located around the shaft portion of fastener 259 and disposed beneath the head of fastener 259 and above flange 253. In some embodiments, spring 261 may be trapped around the shaft portion of fastener 259 and disposed beneath the head of fastener 259 and above flange 253. In some embodiments, fastener 259 and its associated spring 261 may permit up and down travel motion between the top of reflector 223 and holding-plate 241, along the shaft of fastener 259 and for a finite distance of the length of the shaft or less (wherein in some embodiments, this distance may be gap 601). In some embodiments, a quantity of springs 261 may match a quantity of protrusions-of-side-wall 227, apertures 255, and/or fasteners 259. In some embodiments, trim 321 may comprise one, two, three, or four springs 261. In some embodiments, flangeless trim assembly 200 may comprise at least one springs 261. In some embodiments, flangeless trim assembly 200 may comprise one, two, three, or four springs 261.

Figure 2C:
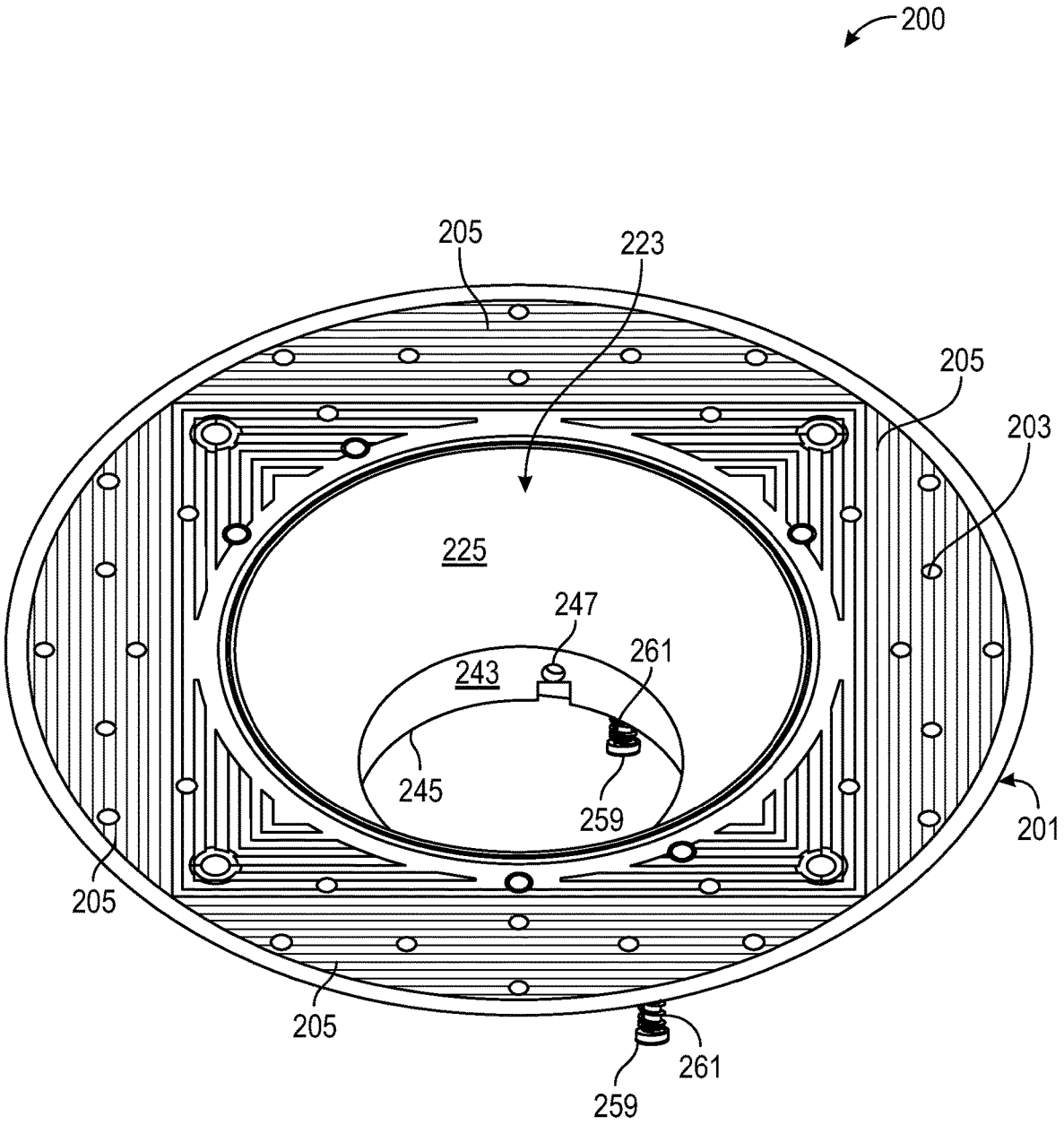
FIG. 2C depicts a bottom perspective of a flangeless trim assembly of FIG. 2A.
Figure 2D:
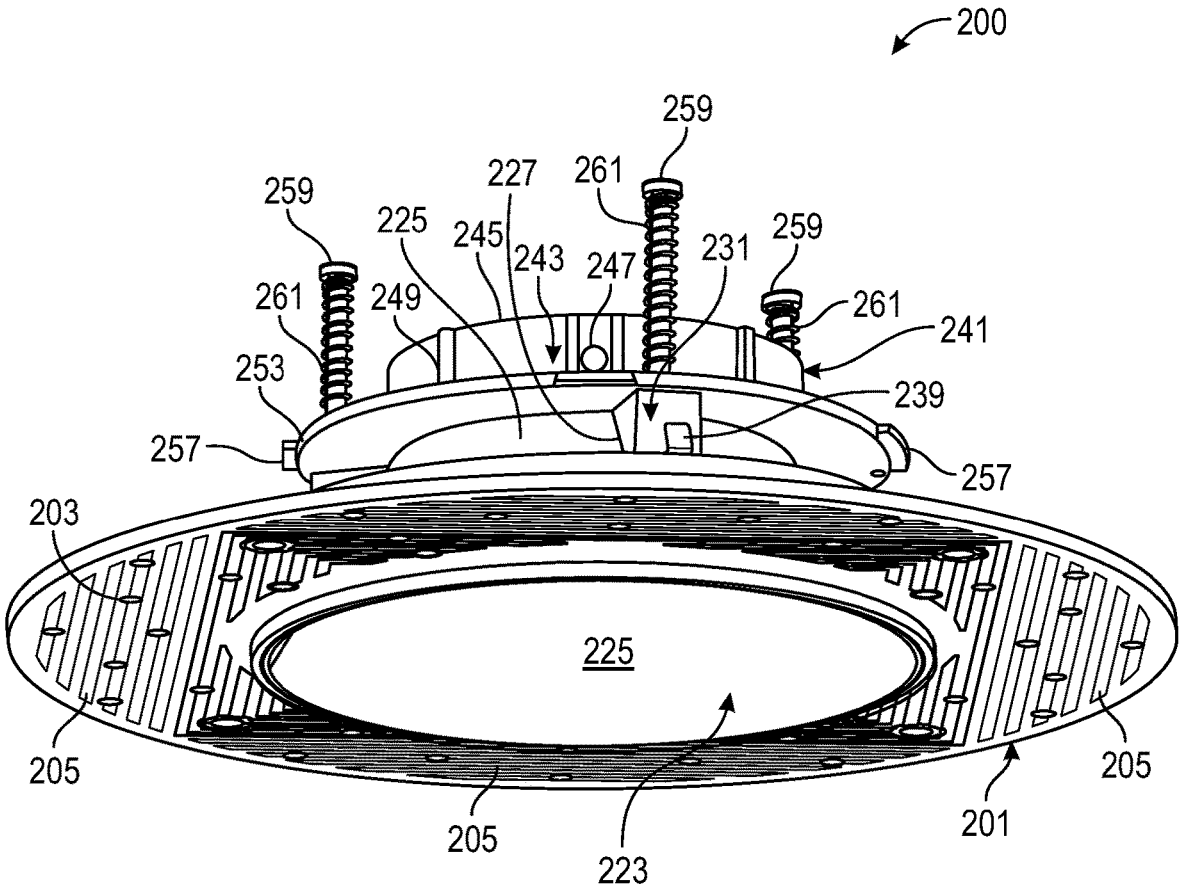
FIG. 2D depicts a slightly different bottom perspective of flangeless trim assembly of FIG. 2A.
Figure 2E:
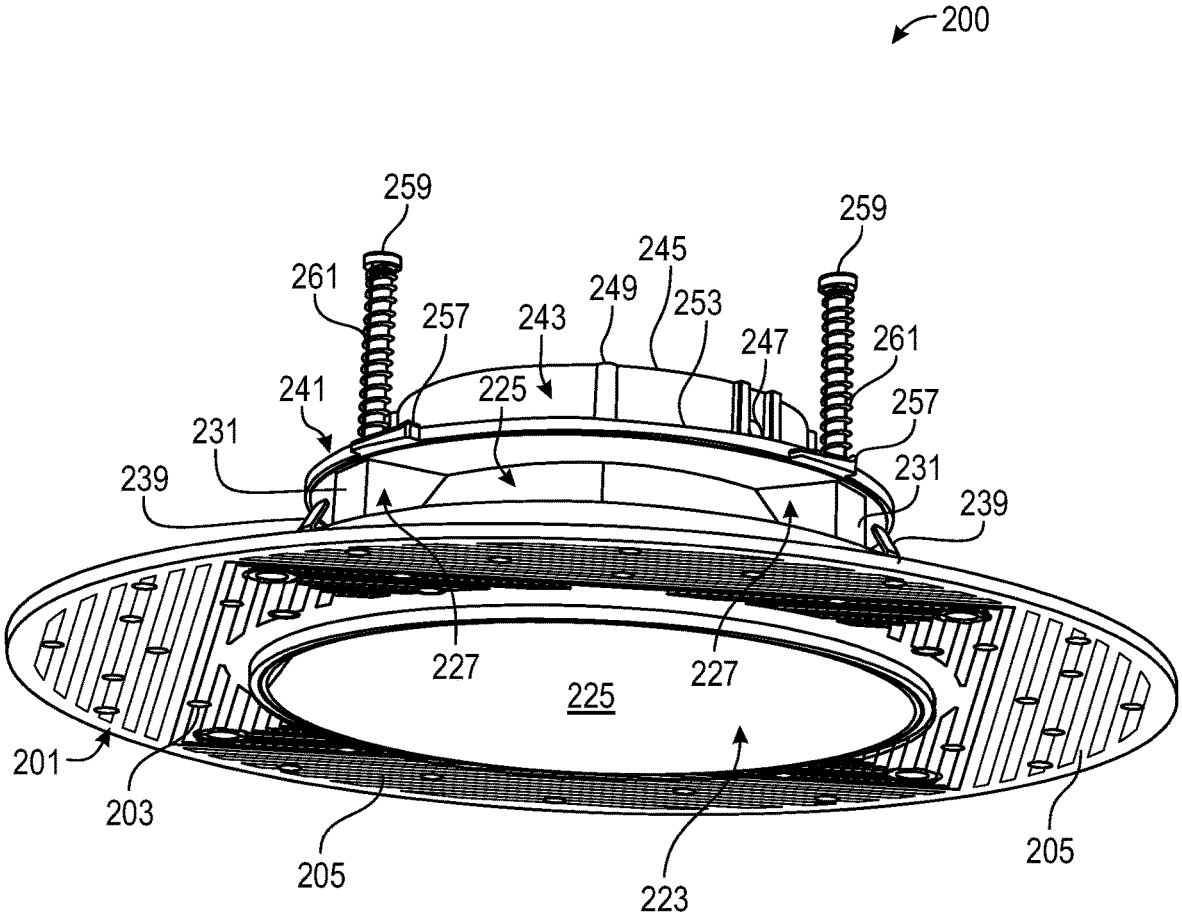
FIG. 2E depicts a yet another slightly different bottom perspective of flangeless trim assembly of FIG. 2A.

FIG. 2C depicts a bottom perspective of a flangeless trim assembly 200. FIG. 2D depicts a slightly different bottom perspective of flangeless trim assembly 200. FIG. 2E depicts a yet another slightly different bottom perspective of flangeless trim assembly 200. From FIG. 2C, FIG. 2D, and/or FIG. 2E, groove(s) 205 of a bottom of spackle-frame 201 may be visible. In some embodiments, a bottom of the disc member of spackle-frame 201 may comprise one or more groove(s) 205. In some embodiments, a bottom of the disc member of spackle-frame 201 may comprise a plurality of grooves 205. In some embodiments, groove 205 may be configured to receive spackle. In some embodiments, groove 205 may provide structure and/or texture for spackle to grip, bond, and/or adhere to.

FIG. 2D and FIG. 2E show that the top of reflector 223 butts up against a bottom of flange 253 of holding-plate 241, when holding-plate 241 may be attached to reflector 223 using fastener(S) 259 and spring(s) 261, and when an external force is not overcoming the spring force of spring(s) 261.

Figure 2F:
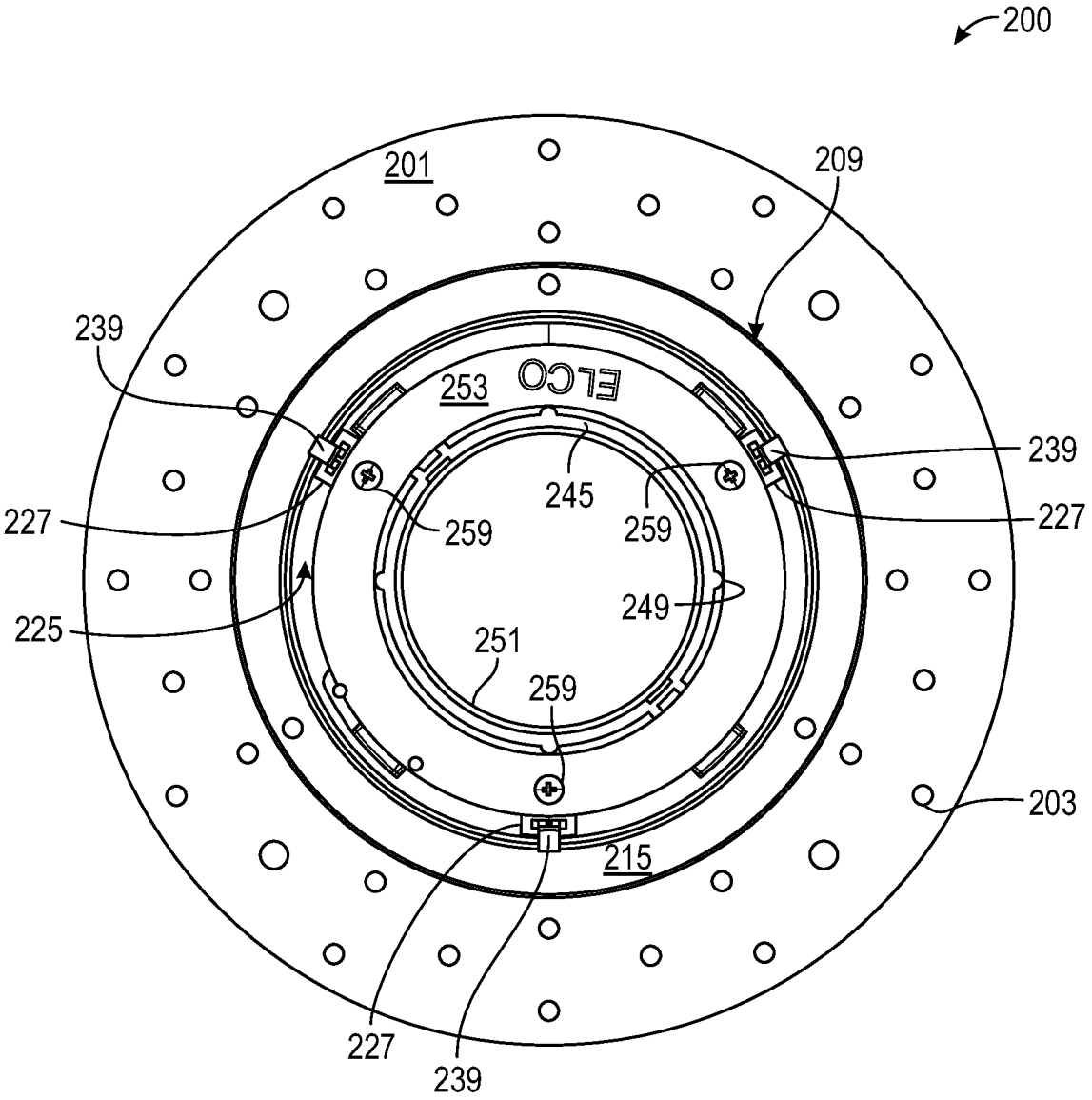
FIG. 2F depicts a top view of flangeless trim assembly of FIG. 2A.

FIG. 2F depicts a top view of flangeless trim assembly 200. FIG. 2F shows an inside-ledge 251 of holding-plate 241. In some embodiments, holding-plate 241 may comprise inside-ledge 251. In some embodiments, inside-ledge 251 may be an annular ridge/ledge that runs substantially/mostly circularly within the main largest central opening of holding-plate 241. In some embodiments, inside-ledge 251 may be configured to provide a stopping point and/or a supportive structure for a bottom portion of lighting module assembly 500 that may be received inside of the main largest central opening of holding-plate 241.

Figure 2G:
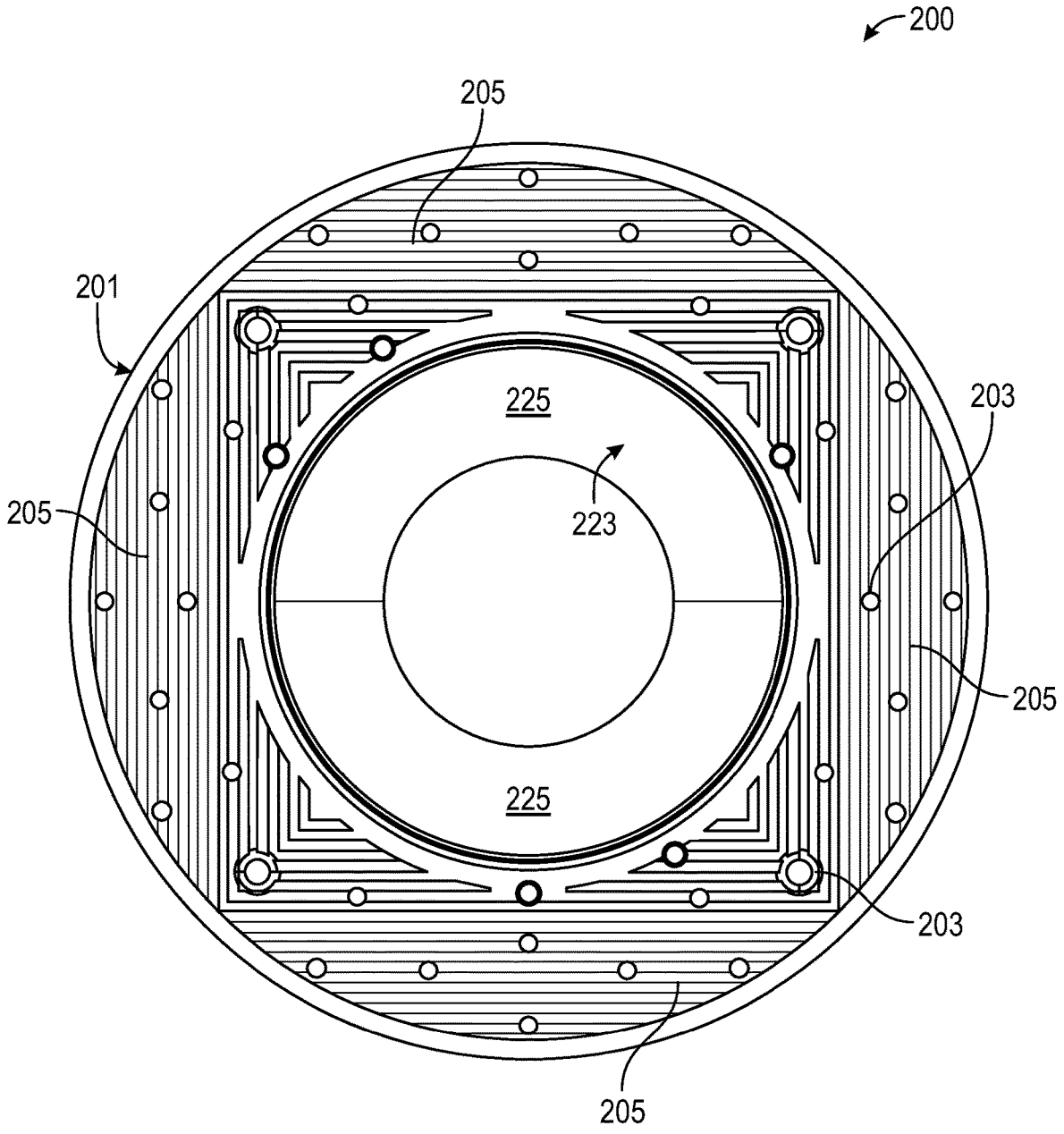
FIG. 2G depicts a bottom view of flangeless trim assembly of FIG. 2A.

FIG. 2G depicts a bottom view of flangeless trim assembly 200. FIG. 2G may be an opposing view to FIG. 2F. From FIG. 2G, grooves 205 and through apertures 203 of spackle-flange 201 may be seen. From FIG. 2G, the interior/bottom facing surfaces of reflector 223, which may be smooth, shiny, and/or reflective, may be seen. Note, when flangeless trim assembly 200 may be installed in ceiling's underside, and the disc member of spackle-flange 201 spackled to that ceiling's underside, the disc member of spackle-flange 201 may no longer be visible (because of the spackling), but the interior/bottom facing surfaces of reflector 223 may still be visible from the bottom as shown in FIG. 2G.

Figure 2H:
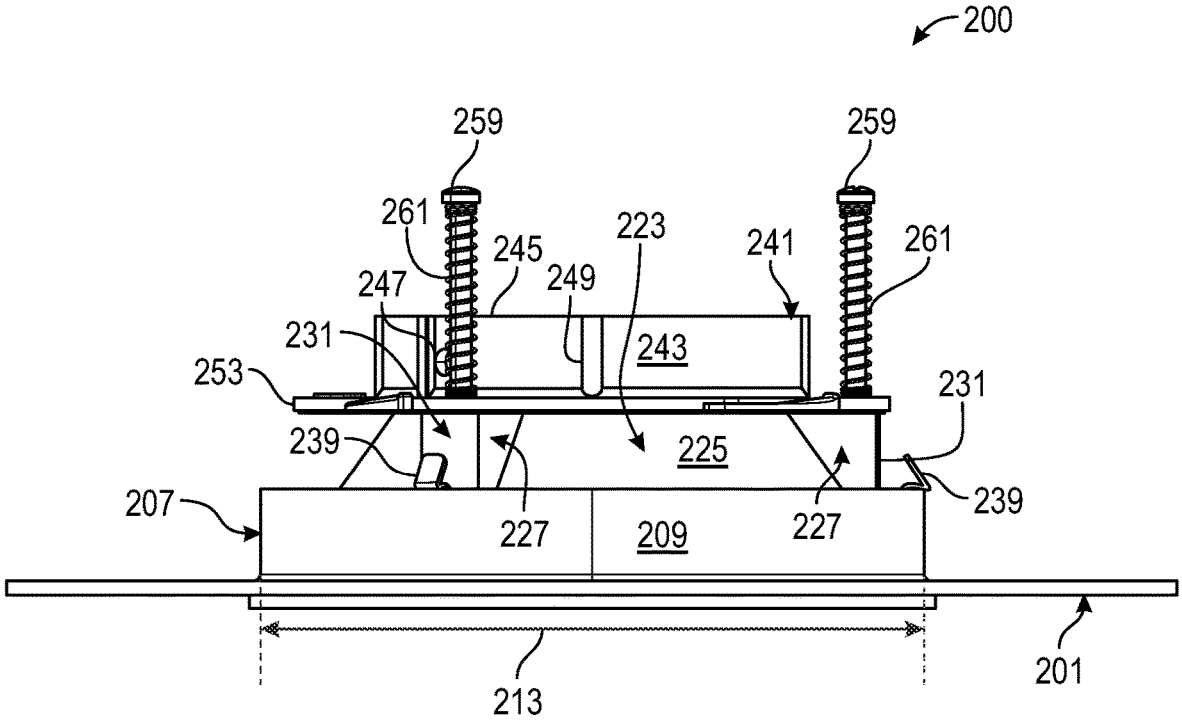
FIG. 2H depicts a left-side view of flangeless trim assembly of FIG. 2A.
Figure 2I:
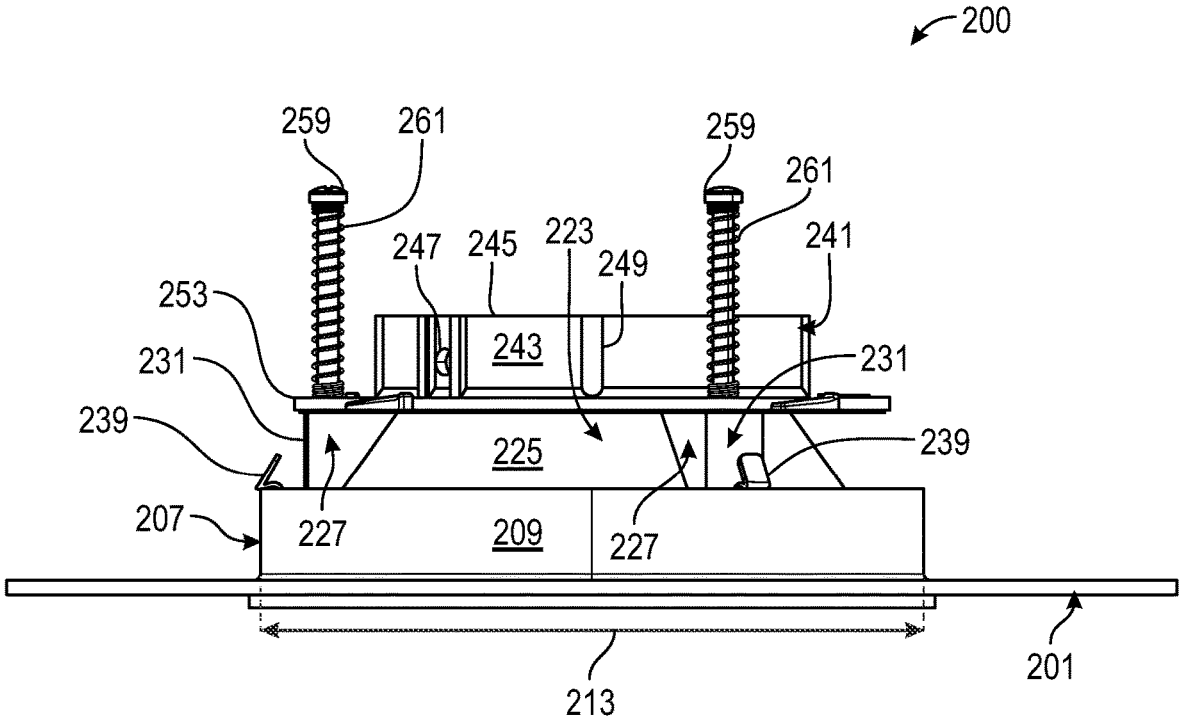
FIG. 2I depicts a right-side view of flangeless trim assembly of FIG. 2A.
Figure 2J:
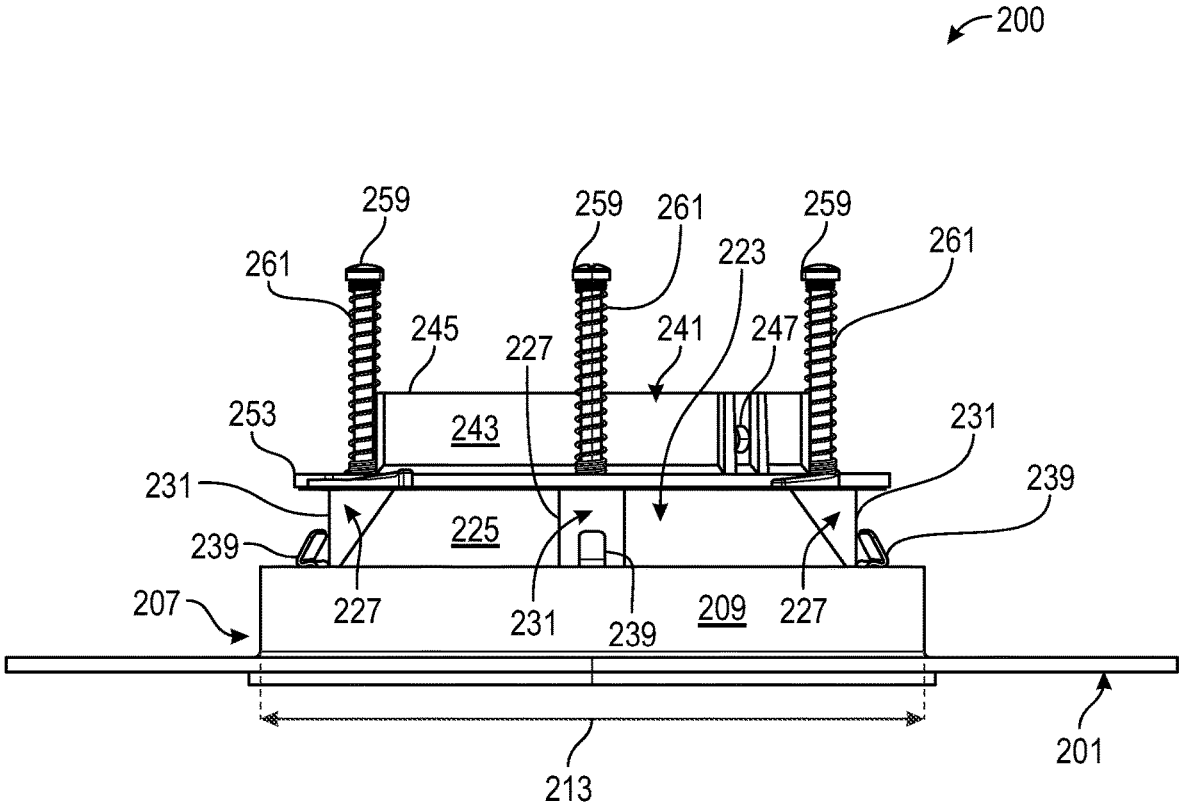
FIG. 2J depicts a front view of flangeless trim assembly of FIG. 2A.
Figure 2K:
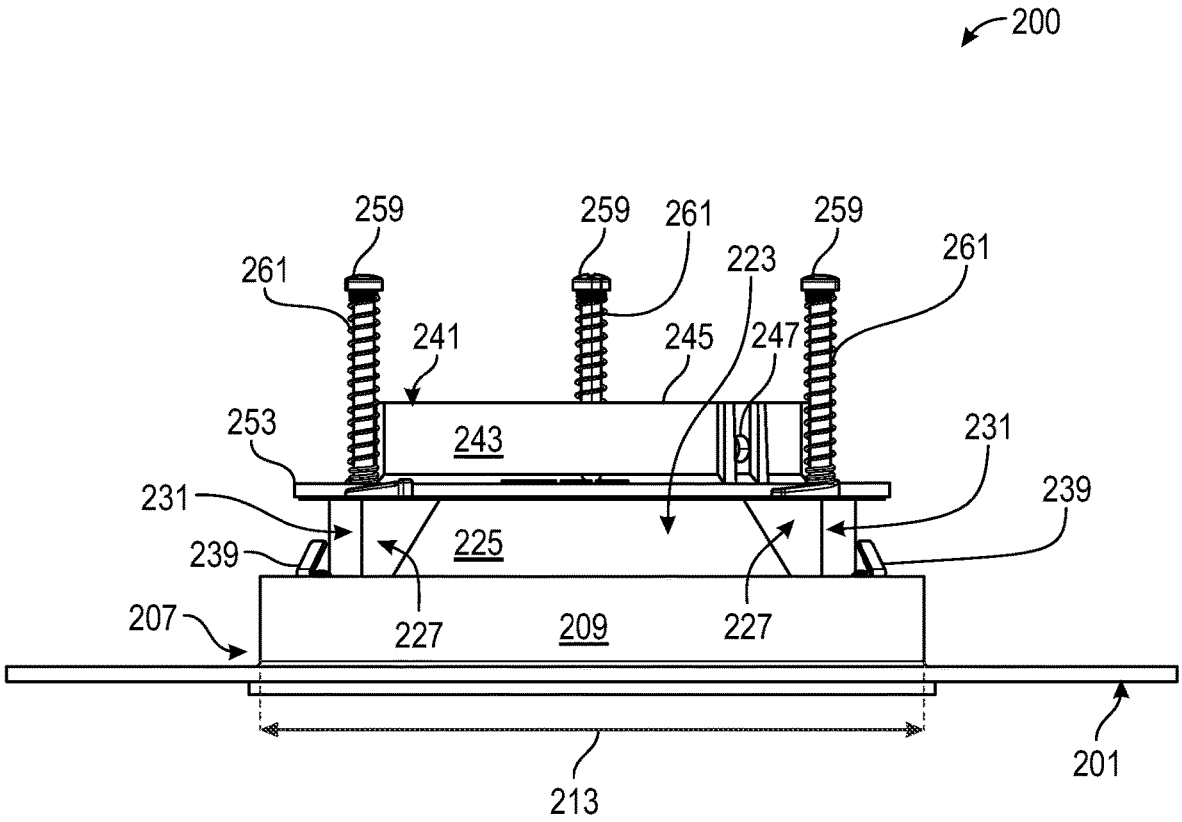
FIG. 2K depicts a rear (back) view of flangeless trim assembly of FIG. 2A.

FIG. 2H depicts a left-side view of flangeless trim assembly 200. FIG. 2I depicts a right-side view of flangeless trim assembly 200. FIG. 2I and FIG. 2H may be opposing views from each other. FIG. 2J depicts a front view of flangeless trim assembly 200. FIG. 2K depicts a rear (back) view of flangeless trim assembly 200. FIG. 2J and FIG. 2K may be opposing views from each other. FIG. 2H through FIG. 2K all show diameter-of-side-wall 213 of side wall 209 of coupler 207. In some embodiments, diameter-of-side-wall 213 may be diameter of side wall 209 of coupler 207. In some embodiments, diameter-of-side-wall 213 may be about a same size as largest central hole 202 of spackle-frame 201. In some embodiments, outside diameters of reflector 223, holding-plate 241, and/or lighting module assembly 500 may be less than diameter-of-side-wall 213. In some embodiments, when reflector 223 may be removably attached to coupler 207 of spackle-frame 201, via clip(s) 239, at least a portion of clip(s) 239 may rest on top of top-opening 211 of side wall 209 of coupler 207. In some embodiments, when reflector 223 may be removably attached to coupler 207 of spackle-frame 201, via clip(s) 239, at least a portion of clip(s) 239 may extend beyond top-opening 211 of side wall 209 of coupler 207 to an outside edge/surface of side wall 209.

Figure 3A:
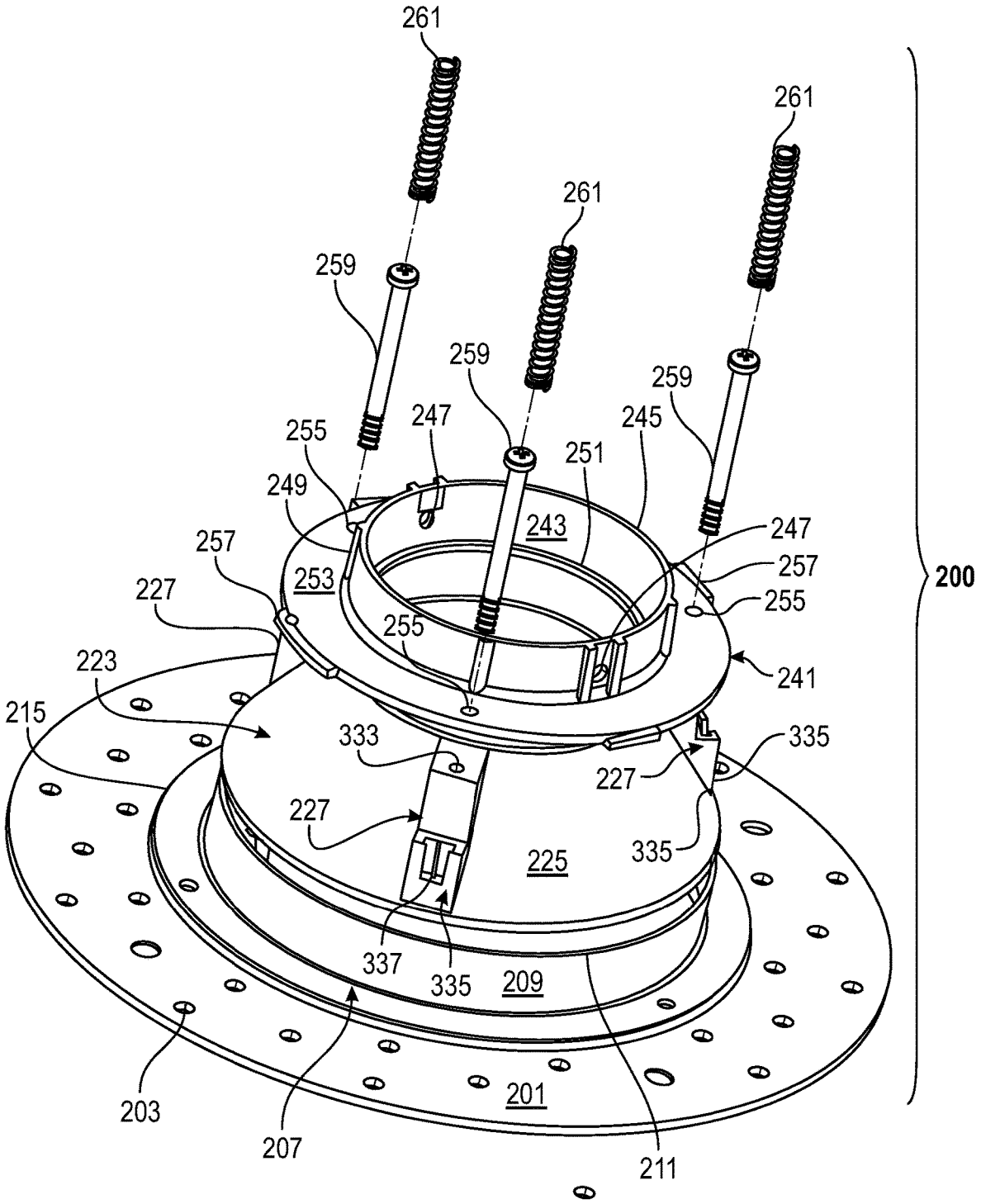
FIG. 3A depicts an exploded top perspective view of flangeless trim assembly of FIG. 2A.
Figure 3B:
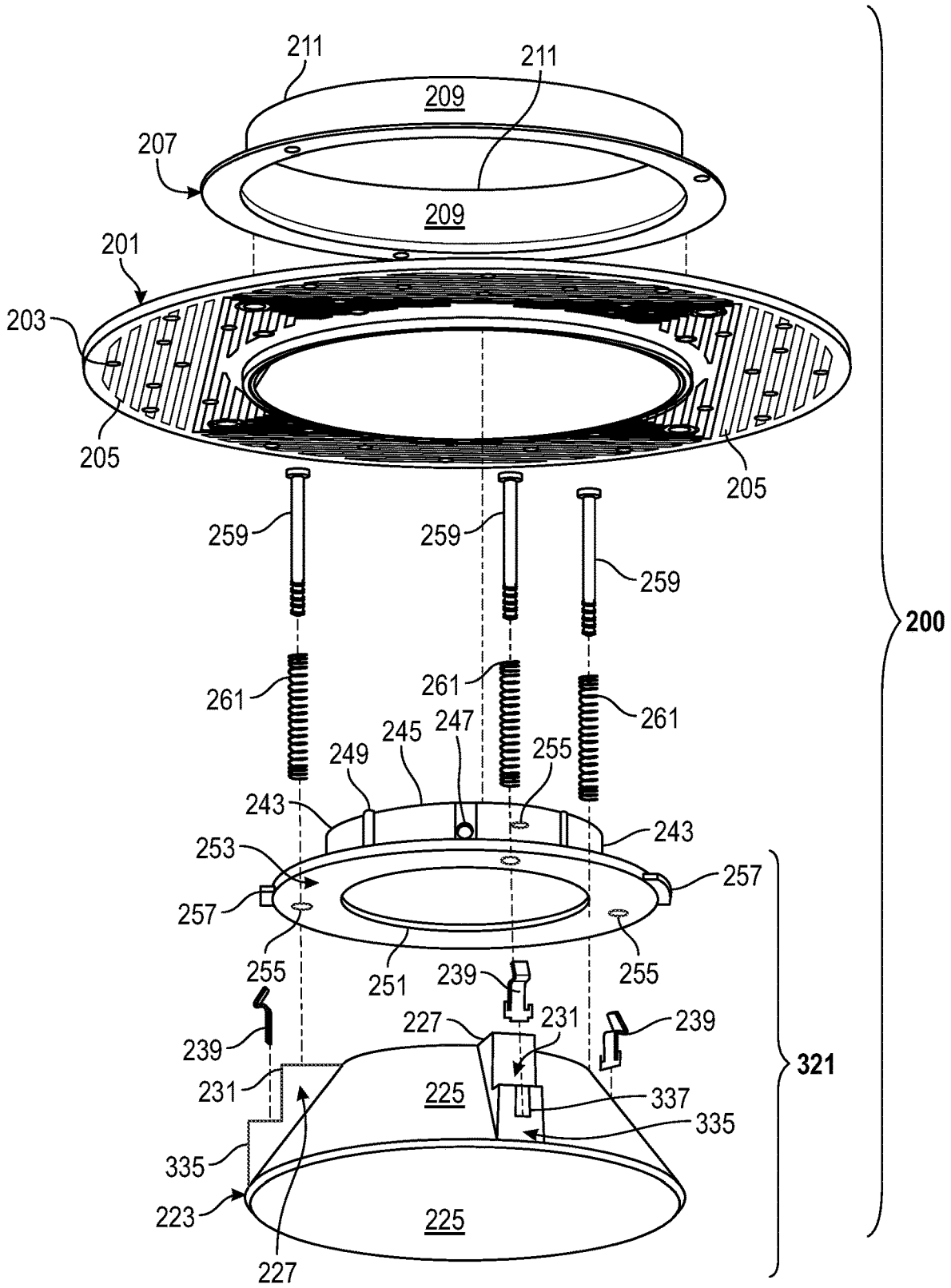
FIG. 3B depicts an exploded bottom perspective view of flangeless trim assembly of FIG. 2A.

FIG. 3A depicts an exploded top perspective view of flangeless trim assembly 200. FIG. 3A shows aperture 333 of protrusion-of-side-wall 227. In some embodiments, protrusion-of-side-wall 227 may comprise at least one aperture 333. In some embodiments, on a top of protrusion-of-side-wall 227 may be least one aperture 333. In some embodiments, top-stepped-face 231 may comprise at least one aperture 333. In some embodiments, on a top of top-stepped-face 231 may be least one aperture 333. In some embodiments, aperture 333 may be a (threaded) hole, that extends partially into 231. In some embodiments, a length of aperture 333 may be substantially parallel with common longitudinal/axial center of flangeless trim assembly 200. In some embodiments, aperture 333 may be configured to receive a distal (threaded) portion of fastener 259. In some embodiments, aperture 333 may be complimentary threaded with respect to distal threading of fastener 259, such that the distal threaded portion of fastener 259 may be threaded and attached to aperture 333. In some embodiments, aperture 333 may not extend all the way through side-wall 225, such that aperture(s) 333 are not visible from bottom views of reflector 223; see e.g., FIG. 2G which does not show any aperture(s) 333 visible.

Continuing discussing FIG. 3A, in some embodiments, a face of protrusion-of-side-wall 227 may be a flat surface that faces radially away from the common longitudinal/axial center of flangeless trim assembly 200. In some embodiments, the faces (top-stepped-face 231 and bottom-stepped-face 335) of protrusion-of-side-wall 227 may be stepped. In some embodiments, protrusion-of-side-wall 227 may comprise two stepped faces, top-stepped-face 231 and bottom-stepped-face 335. In some embodiments, top-stepped-face 231 may be located above bottom-stepped-face 335. In some embodiments, bottom-stepped-face 335 may be located below top-stepped-face 231. In some embodiments, top-stepped-face 231 may be located closer to the top of reflector 223 and further away from the bottom of reflector 223, as compared to bottom-stepped-face 335. In some embodiments, bottom-stepped-face 335 may be located closer to the bottom of reflector 223 and further away from the top of reflector 223, as compared to top-stepped-face 231. In some embodiments, top-stepped-face 231 may be located closer to the common longitudinal/axial center of flangeless trim assembly 200, than bottom-stepped-face 335 is. In some embodiments, bottom-stepped-face 335 may be located further away from the common longitudinal/axial center of flangeless trim assembly 200, than top-stepped-face 231 is. Whereas, in contrast, non-stepped faces 105 of prior art trim 100 may all be located a same distance from the common longitudinal/axial center of prior art trim 100.

Continuing discussing FIG. 3A, in some embodiments, the flat face of top-stepped-face 231 (of protrusion-of-side-wall 227) may be substantially smooth and/or flat. In some embodiments, the flat face of top-stepped-face 231 may be substantially/mostly orthogonal to the top of top-stepped-face 231. In some embodiments, the flat face of top-stepped-face 231 may be in a vertical plane; while the top of top-stepped-face 231 may be in a horizontal plane. In some embodiments, the flat face of top-stepped-face 231 (of protrusion-of-side-wall 227) may be free of (without): apertures that extend radially into the flat face of top-stepped-face 231; holes that extend radially into the flat face of top-stepped-face 231; protrusions that protrude radially out from the flat face of top-stepped-face 231; extensions that extend radially out from the flat face of top-stepped-face 231; ball-bearings that protrude radially out from the flat face of top-stepped-face 231, and/or spring-loaded ball-bearings that protrude radially out from the flat face of top-stepped-face 231; whereas, the top of top-stepped-face 231 may comprise the at least one aperture 333. In some embodiments, protrusion-of-side-wall 227 may be free of (without) spring-loaded ball-bearings that extend radially out past a face of protrusion-of-side-wall 227. In some embodiments, the faces (top-stepped-face 231 and bottom-stepped-face 335) of protrusion-of-side-wall 227 may be stepped; whereas, the single face of non-stepped face 105 of protrusion 103 of prior art trim 100 may not be stepped.

Continuing discussing FIG. 3A, in some embodiments, bottom-stepped-face 335 may comprise clip-receiver 337. In some embodiments, at least one clip-receiver 337 may be located on bottom-stepped-face 335. In some embodiments, clip-receiver 337 may be configured to receive and/or house at least one clip 239. In some embodiments, clip 239 may extend radially outwards, away from the common longitudinal/axial center of flangeless trim assembly 200, and from a bottom of bottom-stepped-face 335. Whereas, in contrast, prior art spring-loaded ball bearing 107 extend radially outwards away from the common longitudinal/axial center of prior art trim 100, and from a top of non-stepped face 105 of prior art trim 100.

Figure 4A:
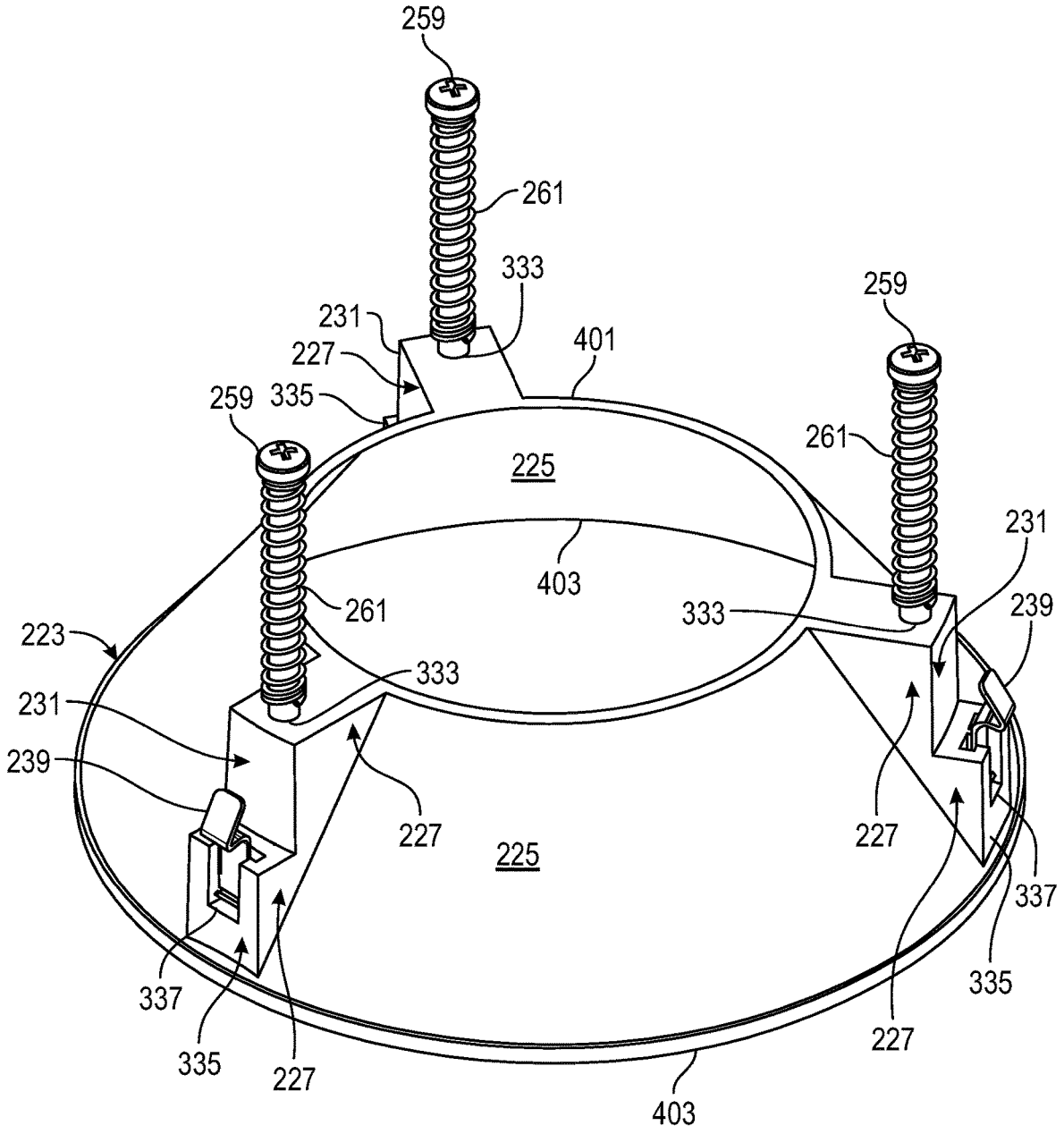
FIG. 4A depicts a top perspective view of a reflector and/or a trim, but without a holding-plate.

Note at least some clip(s) 239 are not shown in FIG. 3A, but are shown in other figures, such as, but not limited to FIG. 3B, FIG. 2I, and FIG. 4A.

Continuing discussing FIG. 3A, in some embodiments, the shaft of fastener 259 may not be threaded. In some embodiments, the entirety shaft of fastener 259 may not be threaded. In some embodiments, only a terminal end portion of the shaft of fastener 259, disposed away from the head of fastener 259, may be threaded. In some embodiments, the terminal end that is opposing the head of fastener 259 may be threaded. See also, FIG. 3B.

FIG. 3B depicts an exploded bottom perspective view of flangeless trim assembly 200. In some embodiments, flangeless trim assembly 200 may comprise at least one trim 321. FIG. 3B may show that trim 321 may be a subassembly comprising at least one reflector 223 and at least one holding-plate 241. In some embodiments, trim 321 may comprise: at least one reflector 223, at least one holding-plate 241, and one clip 239 per each protrusion-of-side-wall 227. In some embodiments, trim 321 may comprise: at least one reflector 223, at least one holding-plate 241, one clip 239 per each protrusion-of-side-wall 227, and one fastener 259 per each protrusion-of-side-wall 227. In some embodiments, trim 321 may comprise: at least one reflector 223, at least one holding-plate 241, one clip 239 per each protrusion-of-side-wall 227, one fastener 259 per each protrusion-of-side-wall 227, and one spring 261 per each fastener 259. In some embodiments, trim 331 may have a common longitudinal/axial center. In some embodiments, components and/or parts of trim 331 may share a common longitudinal/axial center.

Continuing discussing FIG. 3B, in some embodiments, reflector 223 may be removably attached to coupler 207 of spackle-frame 201, by portions of clip(s) 239 of reflector 223 resting on top of top-opening 211 of coupler 207 of spackle-frame 201. In some embodiments, clip(s) 239 may be attached to bottom-stepped-face 335 at clip-receiver(s) 337. In some embodiments, to disengage clip 239, to detach reflector 223 from coupler 207, a human finger (or the like) may be used to press a top portion of clip 239 inwards towards the common longitudinal/axial center of flangeless trim assembly 200 and away from top-opening 211 of coupler 207 of spackle-frame 201.

Continuing discussing FIG. 3B, in some embodiments, holding-plate 241 may be attached to reflector 223, by a portion of fastener 259 running through aperture 255 of flange 253 of holding-plate 241 and by a distal and different portion of that same fastener 259 being received into aperture 333 of the top of top-stepped-face 231 of protrusion-of-side-wall 227 of reflector 223.

FIG. 4A through FIG. 4G may depict reflector 223 and/or trim 321, but without showing holding-plate 241 from various views.

FIG. 4A depicts a top perspective view of reflector 223 and/or trim 321, but without holding-plate 241. Some top-stepped-faces 231 may be seen in FIG. 4A as portions of protrusions-of-side-wall 227. In FIG. 4A, apertures 333 may be shown on top of a portion of top-stepped-face 231, but not on the sides nor face of top-stepped-face 231. These apertures 333 may be configured to each receive a single terminal/distal portion of a given fastener 259. These apertures 333 may each receive a single terminal/distal portion of a given fastener 259. Sides and the face of top-stepped-faces 231, that may be substantially/mostly orthogonal to the top of top-stepped-faces 231, may be entirely free of (without): holes; apertures; projections; extensions; ball-bearings; spring-loaded ball-bearings; portions thereof; combinations thereof; and/or the like. Some bottom-stepped-faces 335 may be seen in FIG. 4A as different portions of protrusions-of-side-wall 227. Each bottom-stepped-faces 335 may comprise a clip-receiver 337. Each clip-receiver 337 may comprise at least one clip 239.

Continuing discussing FIG. 4A, in some embodiments, reflector 223 may comprise smaller-top-opening 401 and larger-bottom-opening 403. In some embodiments, smaller-top-opening 401 and larger-bottom-opening 403 may be vertically oppositely disposed from each other. In some embodiments, both smaller-top-opening 401 and larger-bottom-opening 403 are circular openings. In some embodiments, a diameter of smaller-top-opening 401 may be smaller than a diameter of larger-bottom-opening 403. In some embodiments, tops of top-stepped-faces 231 may be substantially/mostly flush with a same plane that smaller-top-opening 401 resides in. In some embodiments, a given aperture 333 on a top of top-stepped-face 231 may be located closer to the face of top-stepped-face 231 and further away from smaller-top-opening 401.

Continuing discussing FIG. 4A, in some embodiments, reflector 223 may comprise side-wall 225 and at least one stepped-protrusion 227. In some embodiments, side-wall 225 may form a conical frustum shape that may be hollow, with a smaller-top-opening 401 defining a top of reflector 223 and a larger-bottom-opening 403 defining a bottom of reflector 223. In some embodiments, smaller-top-opening 401 and larger-bottom-opening 403 may be disposed opposite from each other with side-wall 225 located between smaller-top-opening 401 and larger-bottom-opening 403.

Continuing discussing FIG. 4A, in some embodiments, stepped-protrusion 227 may extend out of an exterior of side-wall 225, in an upward direction from the bottom of the reflector 223 and in a radial direction outwards away from the exterior of the side-wall 225. In some embodiments, stepped-protrusion 227 may have two different faces that occupy different planes from each other, wherein the different planes are both perpendicular to a radial direction; wherein the radial direction is from outwards in a linear line from a longitudinal center of reflector 223. In some embodiments, these two different faces of stepped-protrusion 227 may be top-stepped-face 231 and bottom-stepped-face 335. In some embodiments, top-stepped-face 231 may be located above bottom-stepped-face 335. In some embodiments, top-stepped-face 231 may be located closer to the smaller-top-opening 401 than the bottom-stepped-face is. In some embodiments, bottom-stepped-face 335 may be located closer to larger-bottom-opening 403 than the top-stepped-face 231 is. In some embodiments, top-stepped-face 231 may be located closer to the longitudinal center of the reflector 223 than bottom-stepped-face 335.

Continuing discussing FIG. 4A, in some embodiments, bottom-stepped-face 335 may comprise clip-receiver 337 that may be configured to house and hold a portion of clip 239. In some embodiments, stepped-protrusion 227 and/or bottom-stepped-face 335 may comprise clip 239, wherein the portion of clip 239 may be housed and held within clip-receiver 337. In some embodiments, a different portion of clip 239 may be configured to removably engage top-opening 211 of spackle-frame 201; and thereby removably attach reflector 223 to spackle-frame 201. In some embodiments, top-stepped-face 231 and/or stepped-protrusion 227 may comprise a top surface. In some embodiments, this top surface of stepped-protrusion 227 may be substantially/mostly orthogonal to sides of stepped-protrusion 227, top-stepped-face 231, and/or bottom-stepped-face 335. In some embodiments, this top surface may comprise aperture 333, wherein aperture 333 may be configured to receive a distal portion (threaded portion) of fastener 259. In some embodiments, interior walls of aperture 333 may have inside threading that may be complementary to threading of fastener 259.

Continuing discussing FIG. 4A, in some embodiments, stepped-protrusion 227 may be present on a given reflector 223 in a quantity of three distinct stepped-protrusions 227, wherein these stepped-protrusions 227 may be spaced apart equally from each other by about 120 degrees (plus or minus five (5) degrees). In other embodiments, there may be two equally spaced apart stepped-protrusions 227. In other embodiments, there may be four stepped-protrusions 227 spaced apart from each other by about ninety (90) degrees (plus or minus five (5) degrees). In some embodiments, there may be one fastener 259 for each stepped-protrusion 227 present in reflector 223. In some embodiments, there may be one spring 261 for each fastener 259.

Figure 4B:
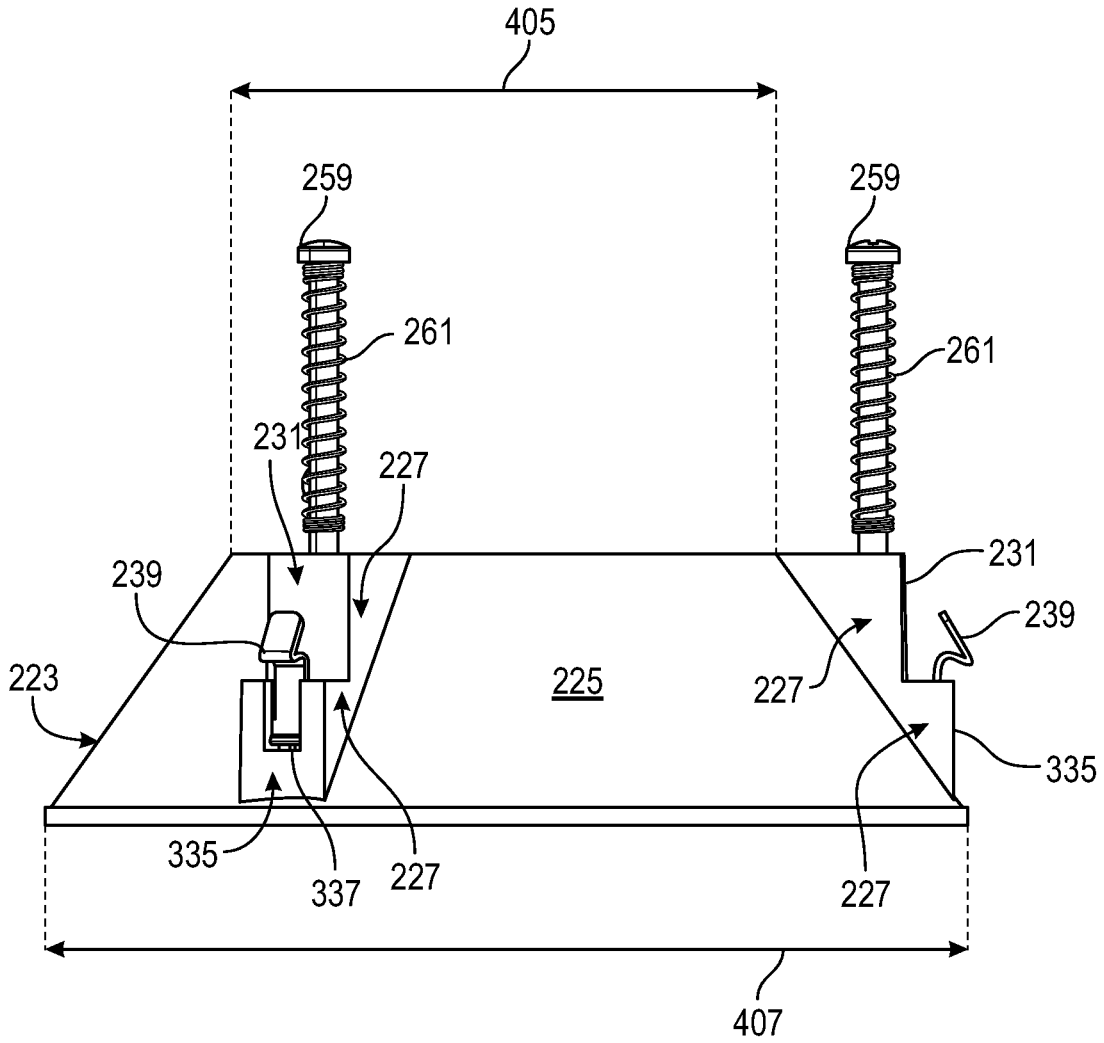
FIG. 4B depicts a left-side view of the reflector and/or the trim of FIG. 4A, but without the holding-plate.
Figure 4C:
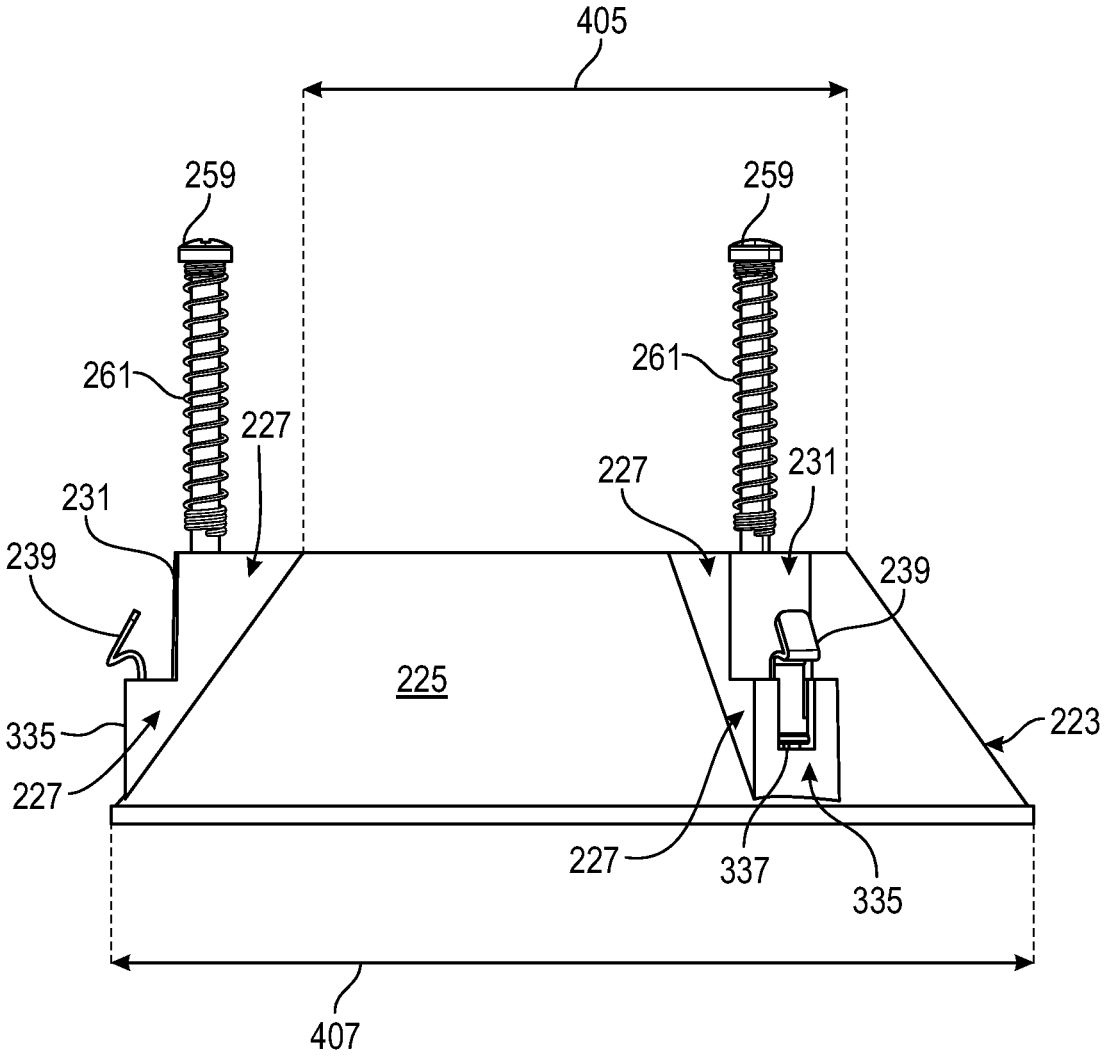
FIG. 4C depicts a right-side view of the reflector and/or the trim of FIG. 4A, but without the holding-plate.

FIG. 4B depicts a left-side view of reflector 223 and/or trim 321, but without holding-plate 241. Compare FIG. 4B to FIG. 2H, as FIG. 2H is also a left-side view, but of flangeless trim assembly 200. FIG. 4C depicts a right-side view of reflector 223 and/or trim 321, but without holding-plate 241. Compare FIG. 4C to FIG. 2I, as FIG. 2I is also a right-side view, but of flangeless trim assembly 200. FIG. 4B and in FIG. 4C show that a portion of clip(s) 239 may extend beyond an outermost portion of larger-bottom-opening 403; which in turn may facilitate clip(s) 239 ability to grab onto a top of top-opening 211 of coupler 207 of spackle-frame 201.

Figure 4D:
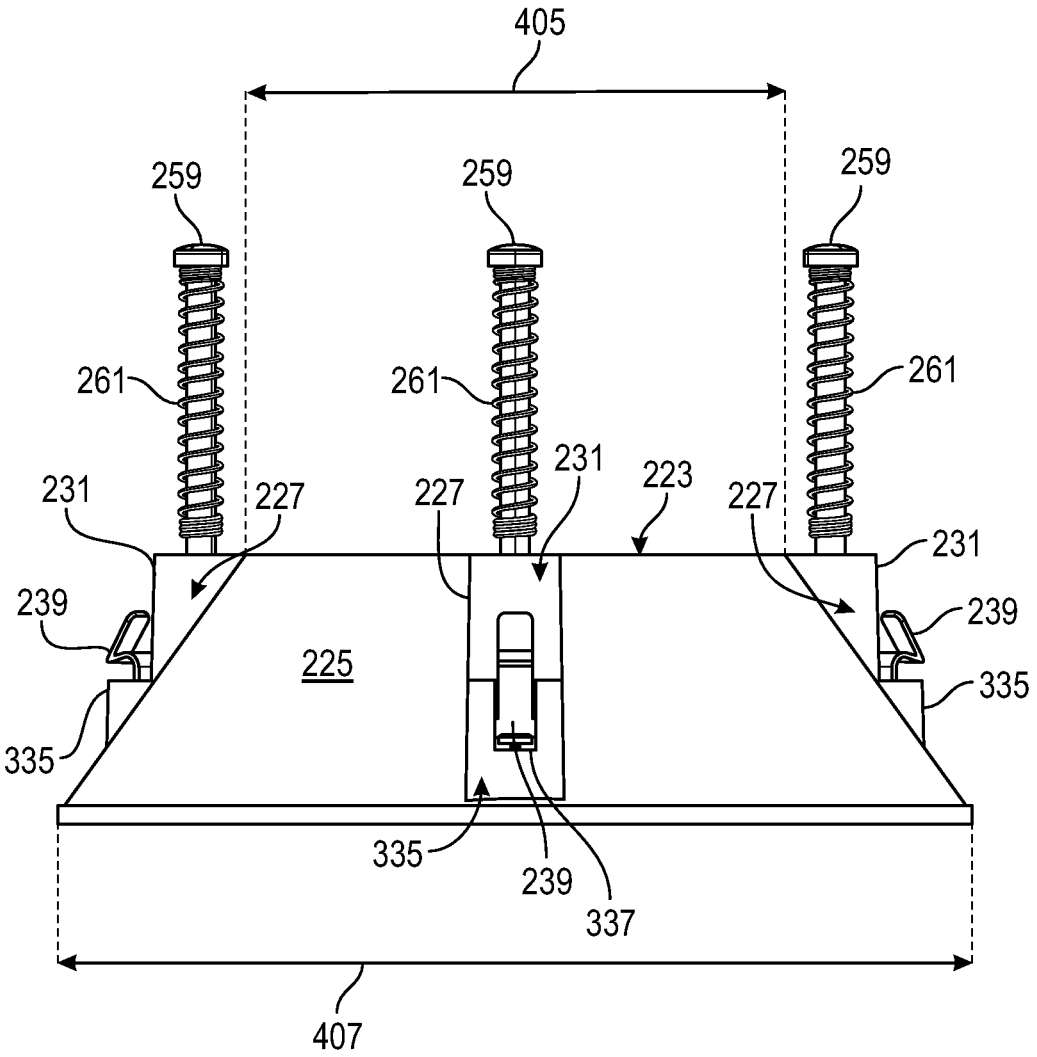
FIG. 4D depicts a front view of the reflector and/or the trim of FIG. 4A, but without the holding-plate.
Figure 4E:
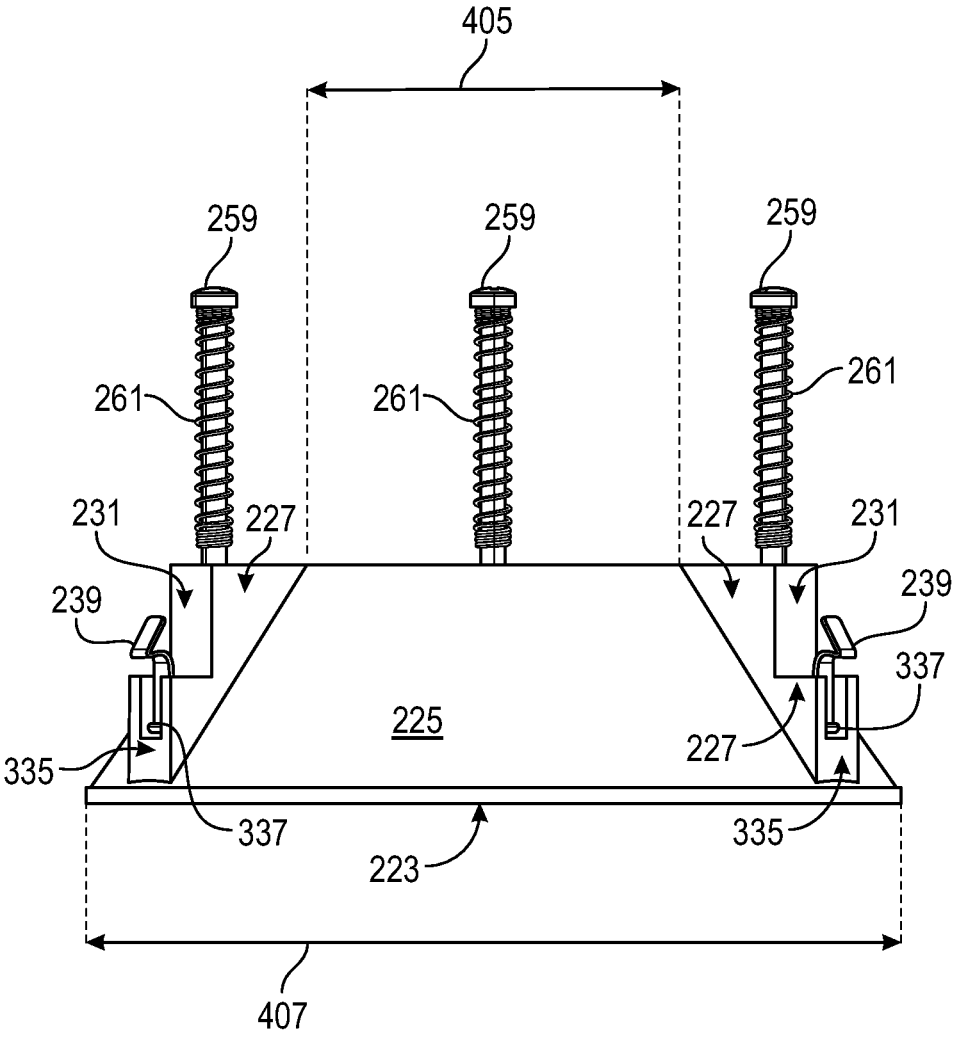
FIG. 4E depicts a back (rear) view of the reflector and/or the trim of FIG. 4A, but without the holding-plate.

FIG. 4D depicts a front view of reflector 223 and/or trim 321, but without holding-plate 241. Compare FIG. 4D to FIG. 2J, as FIG. 2J is also a front view, but of flangeless trim assembly 200. FIG. 4E depicts a back (rear) view of reflector 223 and/or trim 321, but without holding-plate 241. Compare FIG. 4E to FIG. 2K, as FIG. 2K is also a back (rear) view, but of flangeless trim assembly 200. FIG. 4D and FIG. 4E show smaller-diameter 405 of smaller-top-opening 401 and larger-diameter 407 of larger-bottom-opening 403. Smaller-diameter 405 may be smaller than larger-diameter 407. Larger-diameter 407 may be larger than smaller-diameter 405.

Figure 4F:
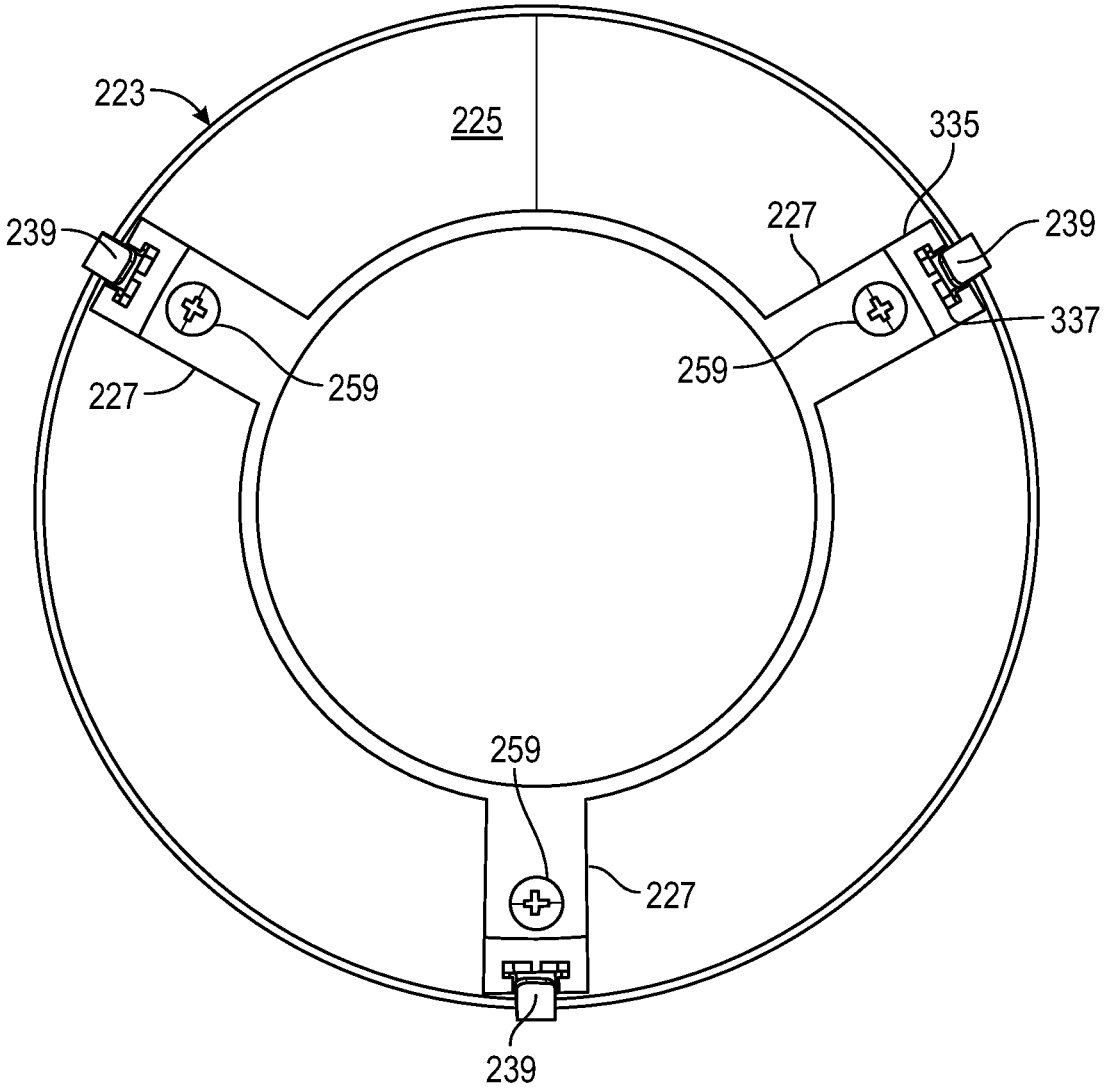
FIG. 4F depicts a top view of the reflector and/or the trim of FIG. 4A, but without the holding-plate.
Figure 4G:
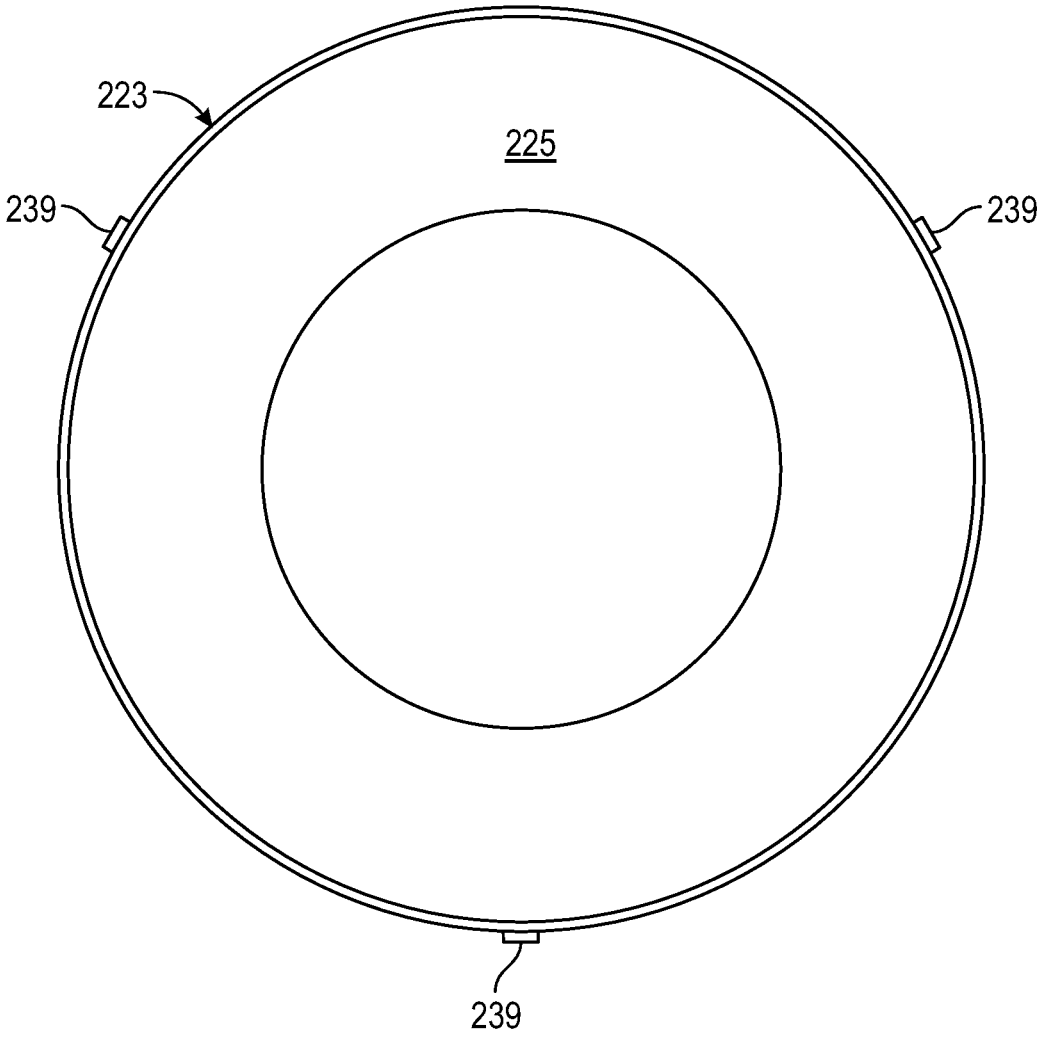
FIG. 4G depicts a bottom view of the reflector and/or the trim of FIG. 4A, but without the holding-plate.

FIG. 4F depicts a top view of reflector 223 and/or trim 321, but without holding-plate 241. Compare FIG. 4F to FIG. 2F, as FIG. 2F is also a top view, but of flangeless trim assembly 200. FIG. 4G depicts a bottom view of reflector 223 and/or trim 321, but without holding-plate 241. Compare FIG. 4G to FIG. 2G, as FIG. 2G is also a bottom view, but of flangeless trim assembly 200. FIG. 4F and FIG. 4G both show that portions of clips 239 may extend/protrude out beyond larger-bottom-opening 403 and/or larger-diameter 407.

Figure 5:
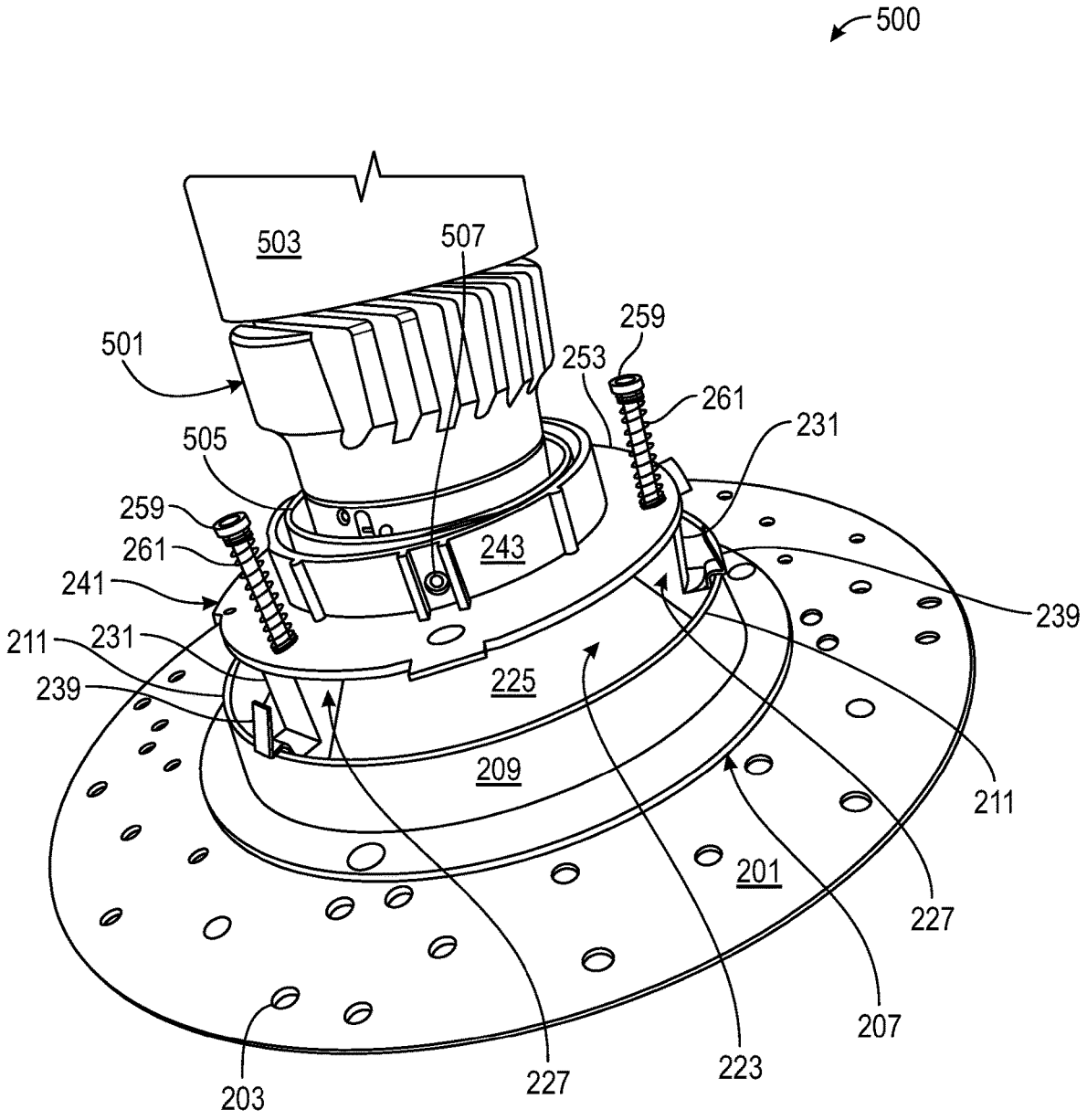
FIG. 5 depicts a partial top perspective view of a lighting module assembly attached to a flangeless trim assembly.

FIG. 5 depicts a partial top perspective view of a lighting module assembly 500 attached to flangeless trim assembly 200. FIG. 5 depicts a partial top perspective view of a lighting module assembly 500 attached to holding-plate 241. In some embodiments, lighting module assembly 500 may be a lighting module, a LED (light emitting diode) lighting module, an integrated lighting module, portions thereof, combinations thereof, and/or the like; wherein when the such lighting module has access to appropriate electrical power, that given lighting module may emit light. In some embodiments, lighting module assembly 500 may comprise: a heat sink module 501, a driver (driver cap) 503, and a lens holder 505 (with lens). Note, a top/upper portion of driver (driver cap) 503 may be omitted in FIG. 5. In some embodiments, lens holder 505 may comprise a LED chip (i.e., a LED integrated circuit) that may be configured for emitting light when appropriately electrically powered. In some embodiments, driver 503 may regulate and/or control overall electrical power received to driver 503 and then provide appropriate electrical power to lens holder 505. In some embodiments, heat sink module 501 may help to emit heat generated by driver 503 and/or by lens holder 505, away from lighting module assembly 500 and/or away from heat sink module 501.

Continuing discussing FIG. 5, in some embodiments, at least a portion of lighting module assembly 500 may be attached to holding-plate 241. In some embodiments, one or more set-fastener(s) 507 may be used to secure the at least the portion of lighting module assembly 500 to holding-plate 241. In some embodiments, this attachment may occur by passing a middle portion of set-fastener(s) 507 through aperture(s) 247 of holding-plate 241, with a distal/terminal portion of set-fastener(s) 507 then frictionally engaging the at least a portion of lighting module assembly 500. In some embodiments, set-fastener(s) 507 may be used to secure/attach lens holder 505 to holding-plate 241 (e.g., via use of aperture(s) 247 of holding-plate 241 and set-fastener(s) 507). In some embodiments, set-fastener 507 may be a mechanical fastener. In some embodiments, set-fastener 507 may be a set screw. In some embodiments, flangeless trim assembly 200, trim 331, holding-plate 241, lighting module assembly 500, and/or lens holder 505 may comprise set-fastener(s) 507.

In some embodiments, when lighting module assembly 500 may be attached to holding-plate 241, all of lighting module assembly 500, all of holding-plate 241, and at least most of reflector 223 may be located above the ceiling where spackle-frame 201 may be attached to that ceiling's bottom surface.

In some embodiments, when lighting module assembly 500 may be attached to holding-plate 241, lighting module assembly 500 along with trim 331 may be moved/translated together as a common/single assembly.

In some embodiments, when lighting module assembly 500 may be attached to holding-plate 241, lighting module assembly 500 along with trim 331 may be moved/translated together as a common/single assembly, separate from spackle-frame 201, wherein spackle-frame 201 may be permanently attached to a ceiling's underside (bottom surface). This arrangement may be facilitated by the attachment between holding-plate 241 and lighting module assembly 500; and by the removable attachment between reflector 223 and coupler 207 (e.g., by virtue of clip(s) 239 of reflector 223).

Figure 6:
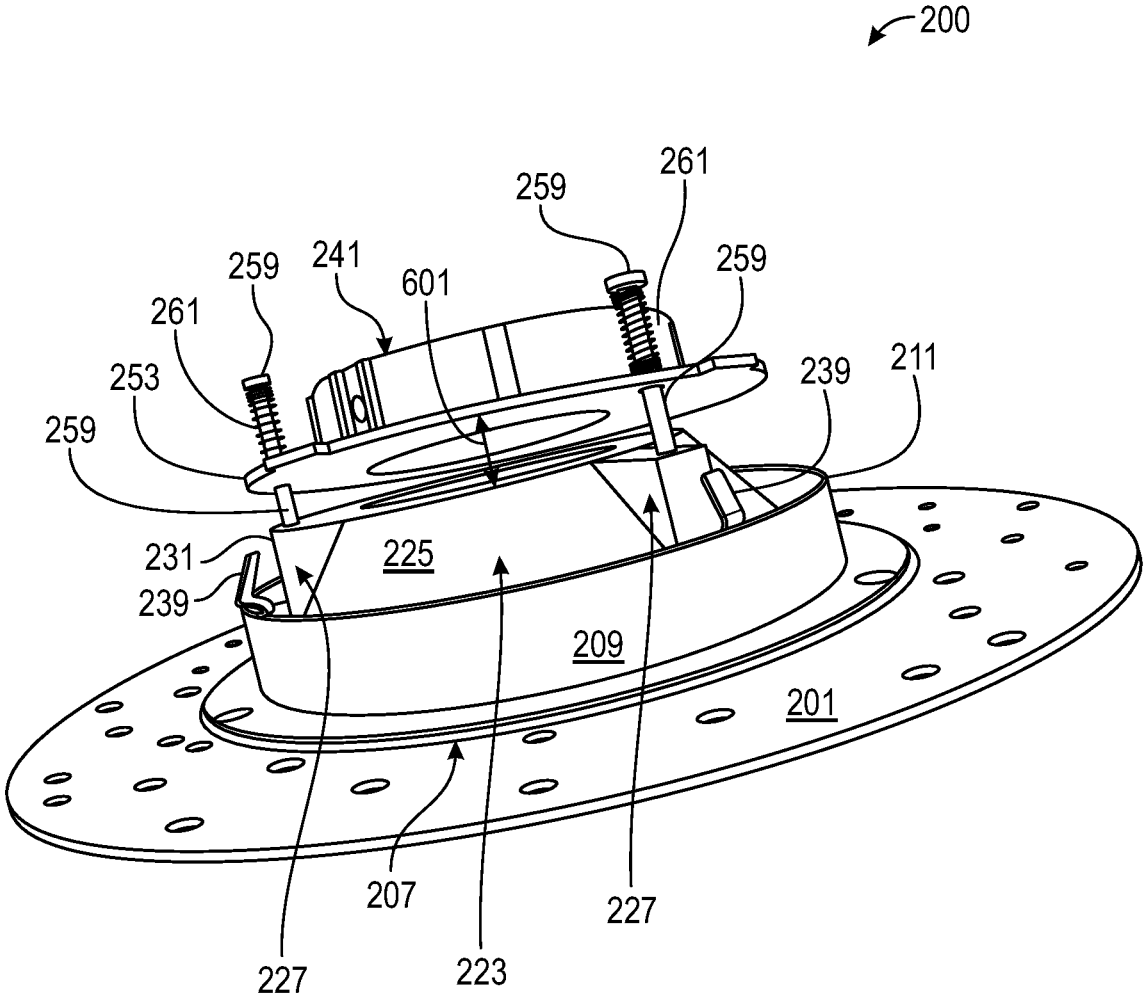
FIG. 6 depicts a top perspective view of flangeless trim assembly, with a (variable) gap between a reflector and a holding-plate, but wherein the reflector is attached to holding-plate.

FIG. 6 depicts a top perspective view of flangeless trim assembly 200. However, FIG. 6 differs from FIG. 2A and FIG. 2B, which are also top perspective views of flangeless trim assembly 200, by showing how holding-plate 241 may be separated from reflector 223, but while holding-plate 241 is still attached to reflector 223. In some embodiments, while holding-plate 241 may be attached to reflector 223, a bottom of flange 253 of holding-plate 241 may be separated from the top of reflector 223, up to a fixed and finite distance, denoted by reference numeral 601. In some embodiments, reference numeral 601 may refer to (variable) gap-between-plate-holder-and-reflector 601. In some embodiments, this movement of holding-plate 241 away from reflector 223 may be accomplished by pushing holding-plate 241 and reflector 223 away from each other with a force that exceeds the force exerted by spring(s) 261. Recall, holding-plate 241 is attached to reflector 223, by distal/terminal ends of fasteners 259 being received into apertures 333 of reflector 223, while shaft portions of fasteners 259 pass through apertures 255 of holding-plate 241, and with springs 261 being disposed around upper shaft portions of fasteners 259 between flange 253 of holding-plate 241 and heads of the fasteners 259. In this situation, without any external forces applied to trim 331, the bottom of flange 253 butts up against the top of reflector 223, by virtue of the forces exerted by the springs 261. However, when an opposing force that is greater than the force of the springs 261 is imparted to trim 331, then holding-plate 241 may be separated from reflector 223, by (variable) gap-between-plate-holder-and-reflector 601, but while holding-plate 241 is still attached to reflector 223. In some embodiments, a direction of travel between reflector 223 and holding-plate 241 may be substantially/mostly parallel with a length direction that fastener(s) 259 run, which may be substantially/mostly parallel with common longitudinal/axial center of flangeless trim assembly 200; and/or a common longitudinal/axial center of trim 331. In some embodiments, a maximum of (variable) gap-between-plate-holder-and-reflector 601 is limited to how far spring 261 may be compressed and by the length of fastener(s) 259.

Figure 7:
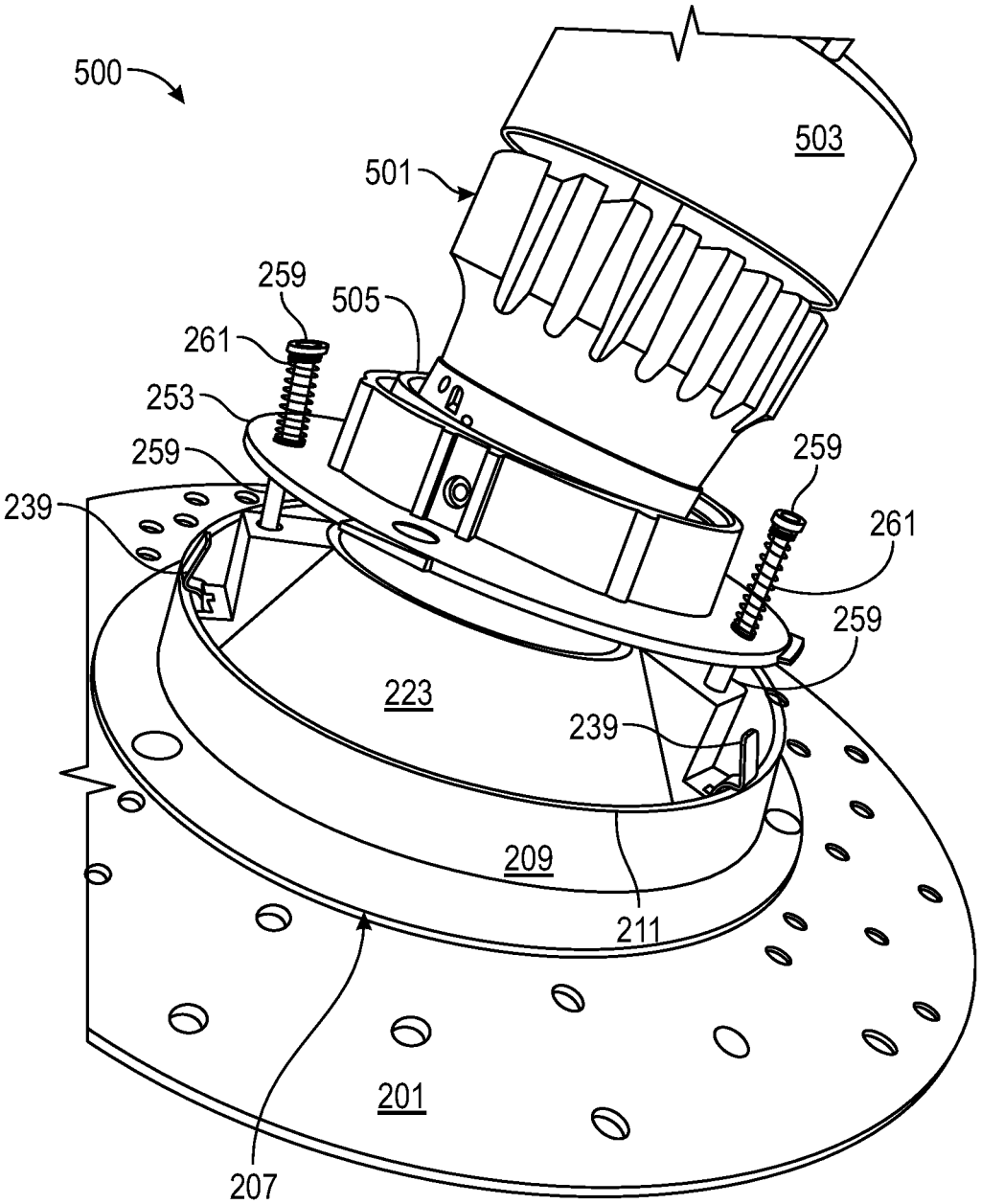
FIG. 7 depicts a top perspective view of a lighting module assembly attached to a holding-plate, and with a (variable) gap between plate-holder and the reflector that is present (shown).

FIG. 7 depicts a top perspective view of lighting module assembly 500 attached to holding-plate 241, and with (variable) gap-between-plate-holder-and-reflector 601 present. Note, when holding-plate 241 and reflector 223 are moved with respect to each other along shafts of fastener(s) 259, holding-plate 241 may or may not be attached to lighting module assembly 500. In some embodiments, when holding-plate 241 may be attached to lighting module assembly 500, holding-plate 241 along with attached lighting module assembly 500 may be moved up and down with respect to reflector 223, along shafts of fastener(s) 259.

Note, when holding-plate 241 and reflector 223 are moved with respect to each other along shafts of fastener(s) 259, reflector 223 may or may not be removably attached to coupler 207. Thus, reflector 223, with attached holding-plate 241, with lighting module assembly 500 attached to holding-plate 241, may be moved independently and in any direction with respect to coupler 207 of spackle-plate 201 (which may be fixed and mounted to ceiling's underside); and this movement may occur with (variable) gap-between-plate-holder-and-reflector 601 present or absent.

Figure 8:
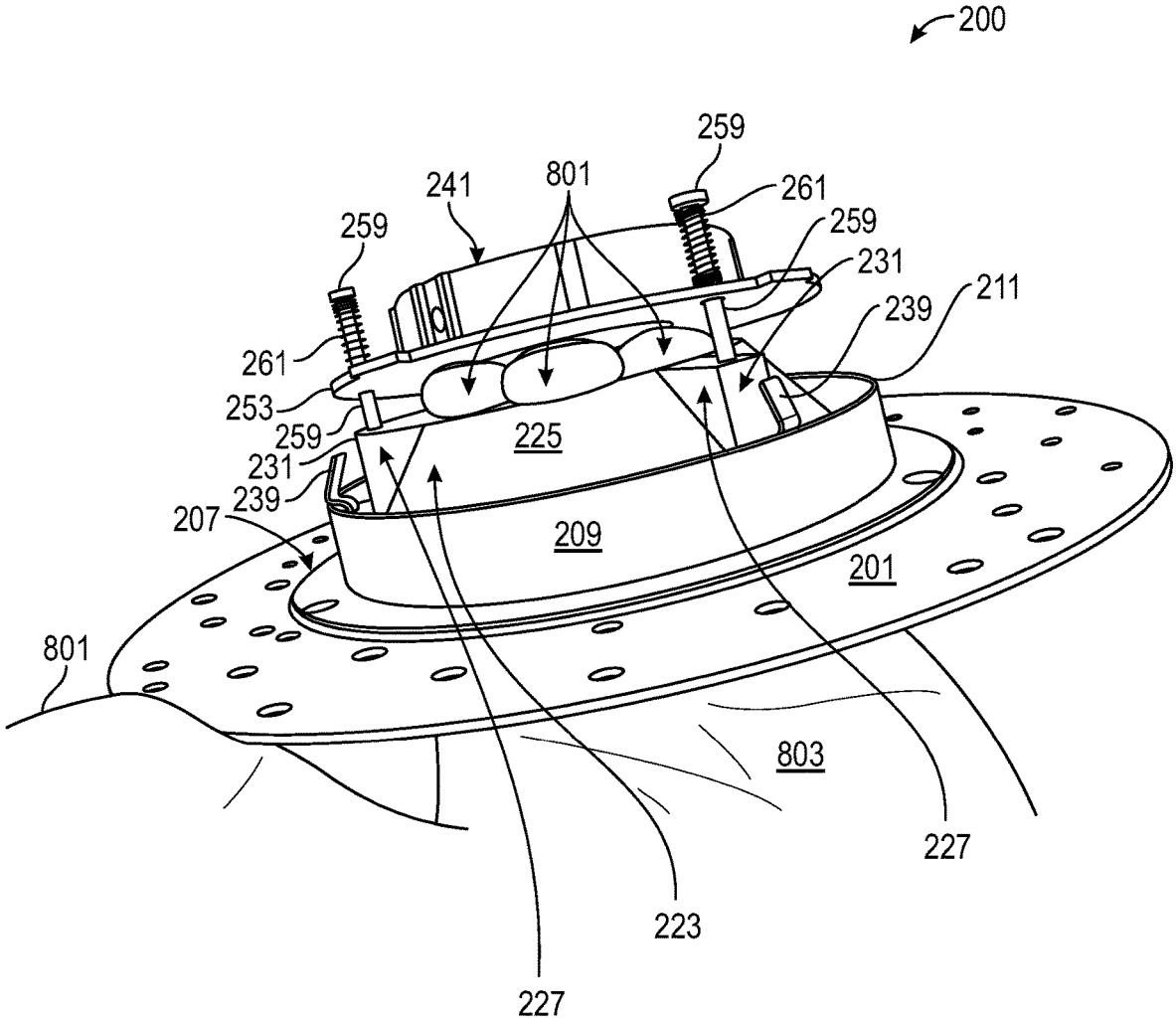
FIG. 8 depicts a top perspective view with a gap between a holding-plate and a reflector 223, along with finger(s) of a person (human) inserted and/or causing that gap.

FIG. 8 depicts a top perspective view (similar to FIG. 6) with gap 601 between holding-plate 241 and reflector 223, along with finger(s) 801 of a person (human) inserted and/or causing gap 601. Portions of hand/palm 803 of that human may also be seen in FIG. 8. In some embodiments, when holding-plate 241 may be attached to reflector 223, gap 601 may be caused and/or maintained by fingers 801 generating the force necessary to overcome the force of springs 261. Thus, gap 601 may be formed and/or maintained without use of tools, aside from human finger(s) 801. Further, once gap 601 is formed and maintained by finger(s) 801, at least one of those same finger(s) 801 or other finger(s) may be used to engage or disengage clip(s) 239 from coupler 207. Thus, without tools, aside from finger(s) 801, an assembly of trim 331 attached to lighting module assembly 500 may be installed/attached to coupler 207, by pushing this assembly into the main/largest central hole(s) of mounted spackle-frame 201 until clip(s) 239 engage with top-opening 211 of coupler 207; also without tools, aside from finger(s) 801, the assembly of trim 331 attached to lighting module assembly 500 may be removed from coupler 207 (and from spackle-frame 201), by finger(s) 801 forming gap 601, by finger(s) 801 disengaging clip(s) 239 from top-opening 211 of coupler 207, and then by pulling this entire assembly down and out of the main/largest central hole(s) of mounted spackle-frame 201.

Figure 9:
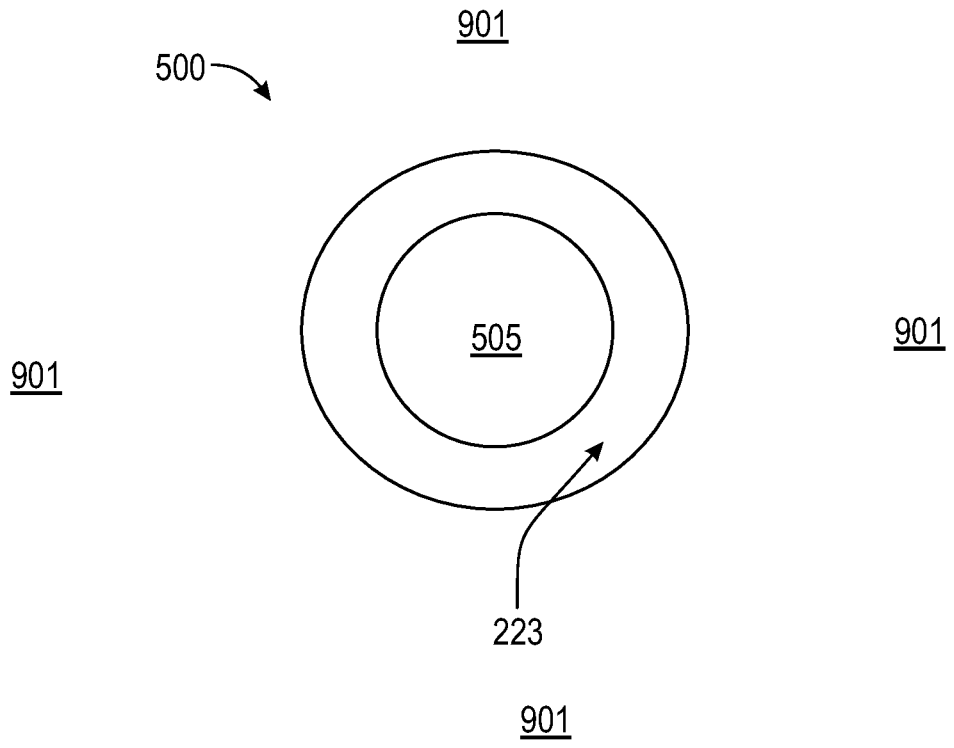
FIG. 9 depicts a bottom view of a flangeless trim assembly installed into a bottom surface (underside) of a given ceiling; wherein spackle and/or paint is entirely covering over a disc member of a spackle-frame so that the disc member of the spackle-frame is not visible from below; and wherein a lighting module assembly is attached to a holding-plate.

FIG. 9 depicts a bottom view of flangeless trim assembly 200 installed into the bottom surface 901 (underside) of a given ceiling; wherein spackle and/or paint is entirely covering over the disc member portions of spackle-frame 201 so that the disc member of spackle-frame 201 is no longer visible from below; and wherein lighting module assembly 500 is attached to holding-plate 241. Thus, all that can be seen by a person below such an installation may be the underside of reflector 223, underside portions of lens holder 205 (i.e., underside portions of the lens), and perhaps a small portion of holding-plate 241. The reflector 223 will look to be installed seamlessly with respect to that ceiling's bottom surface 901 (underside), i.e., without a trim flange. And if one wanted to remove the assembly of trim 331 attached to lighting module assembly 500, one could do so with only finger(s) 801, by starting by forming gap 601.

Figure 10A:
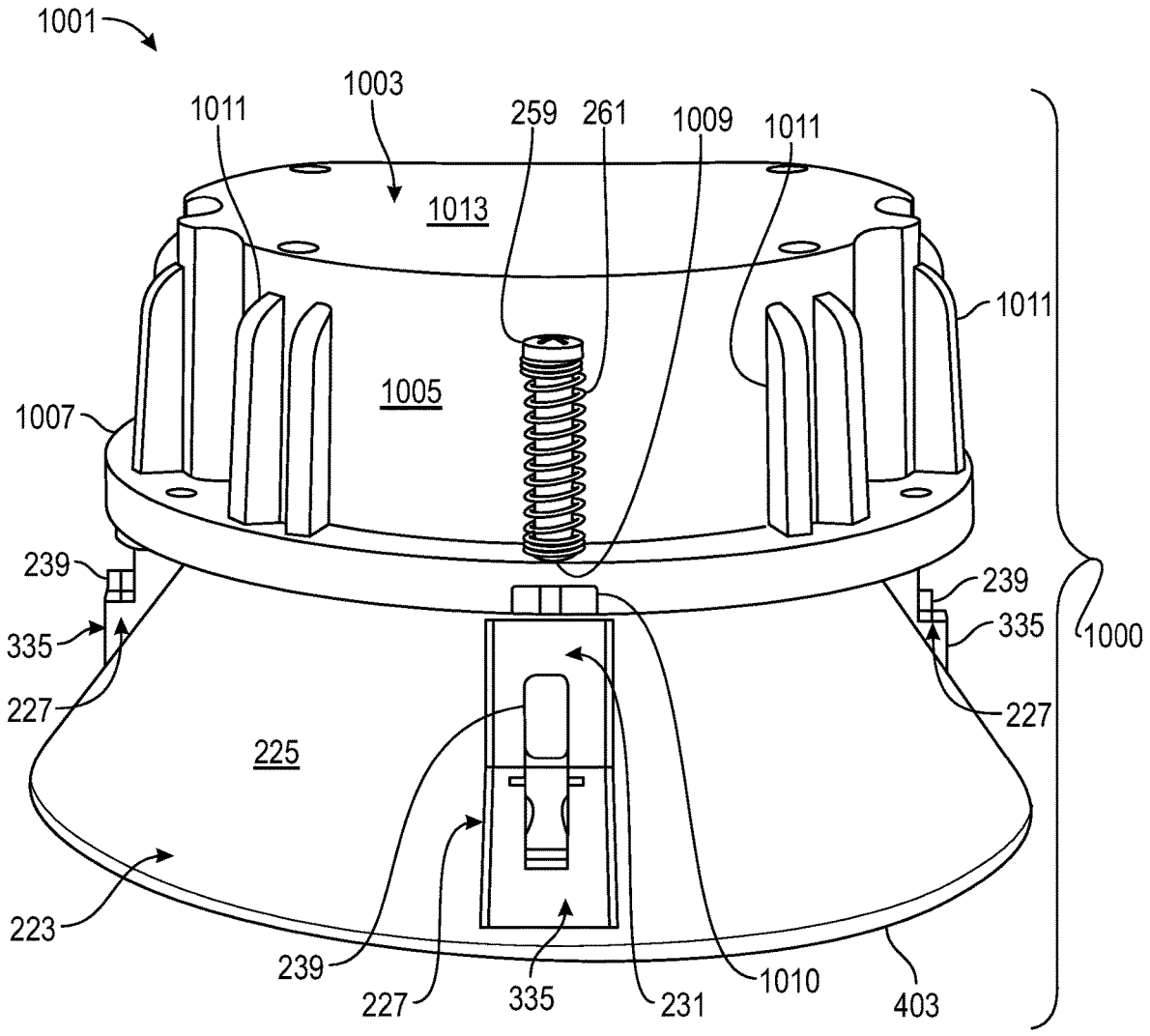
FIG. 10A depicts a reflector-and-light-module-subassembly that does not use (include) an intermediary holding-plate (mounting-plate) disposed between the reflector and the lighting module, shown from a top perspective view.
Figure 10B:
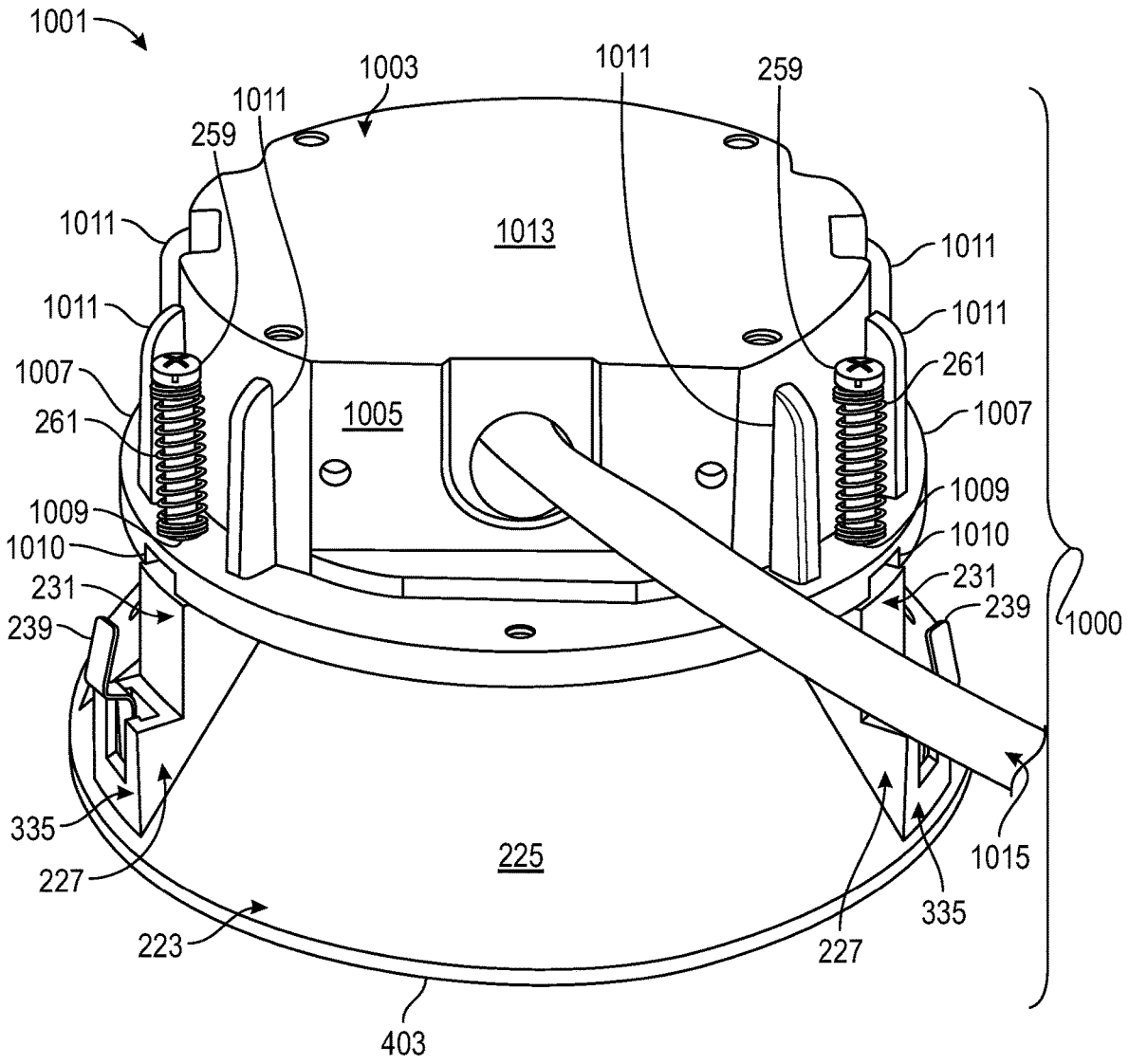
FIG. 10B shows the reflector-and-light-module-subassembly of FIG. 10A from another top perspective view.
Figure 10C:
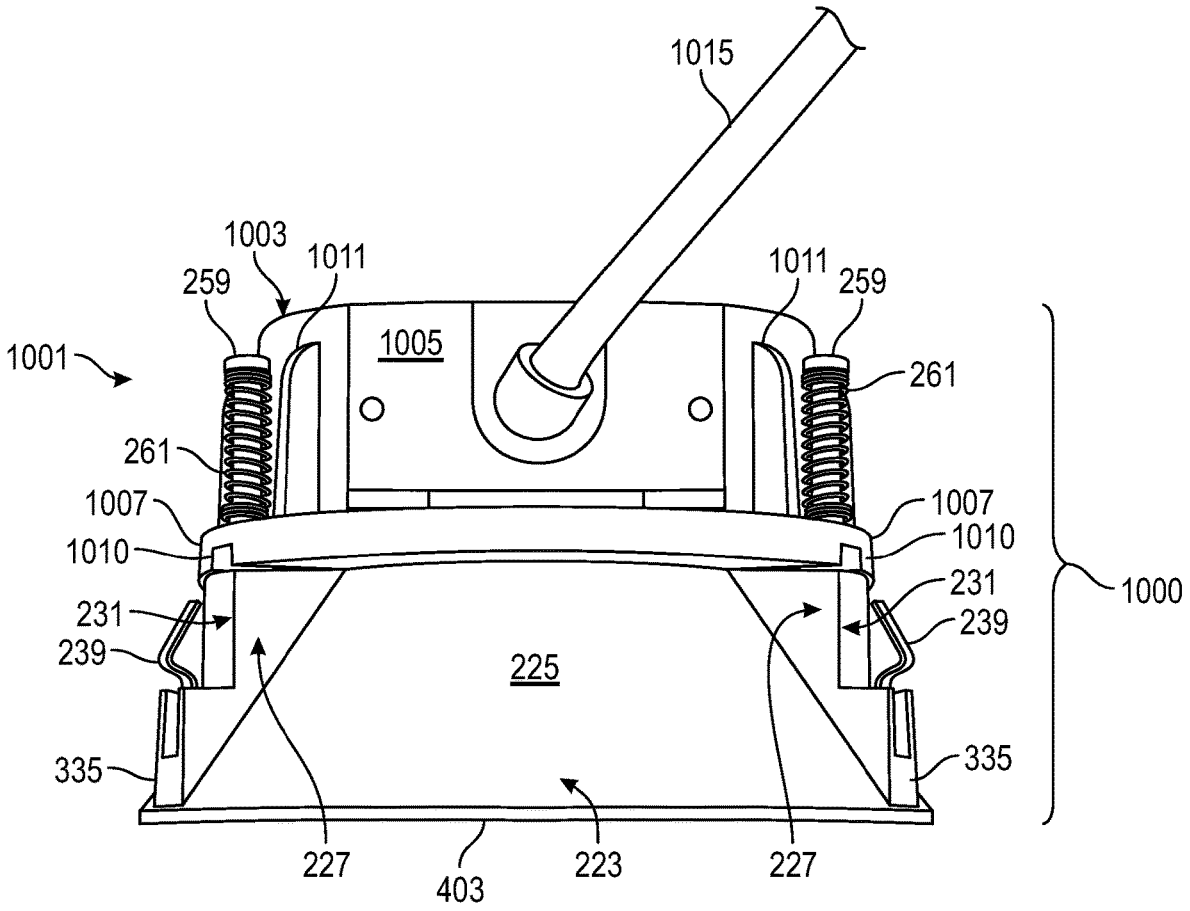
FIG. 10C shows the reflector-and-light-module-subassembly of FIG. 10A from a side or a rear view.
Figure 10D:
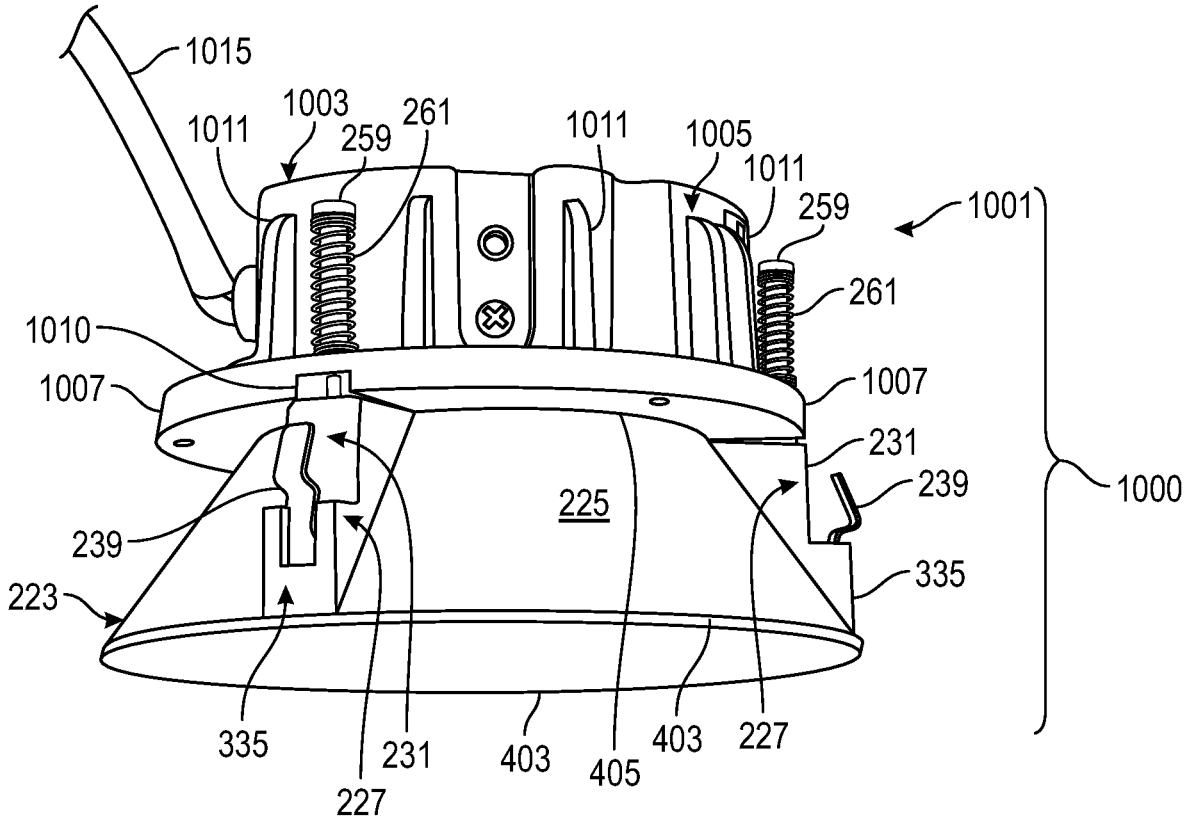
FIG. 10D shows the reflector-and-light-module-subassembly of FIG. 10A from a slight bottom perspective view.
Figure 10E:
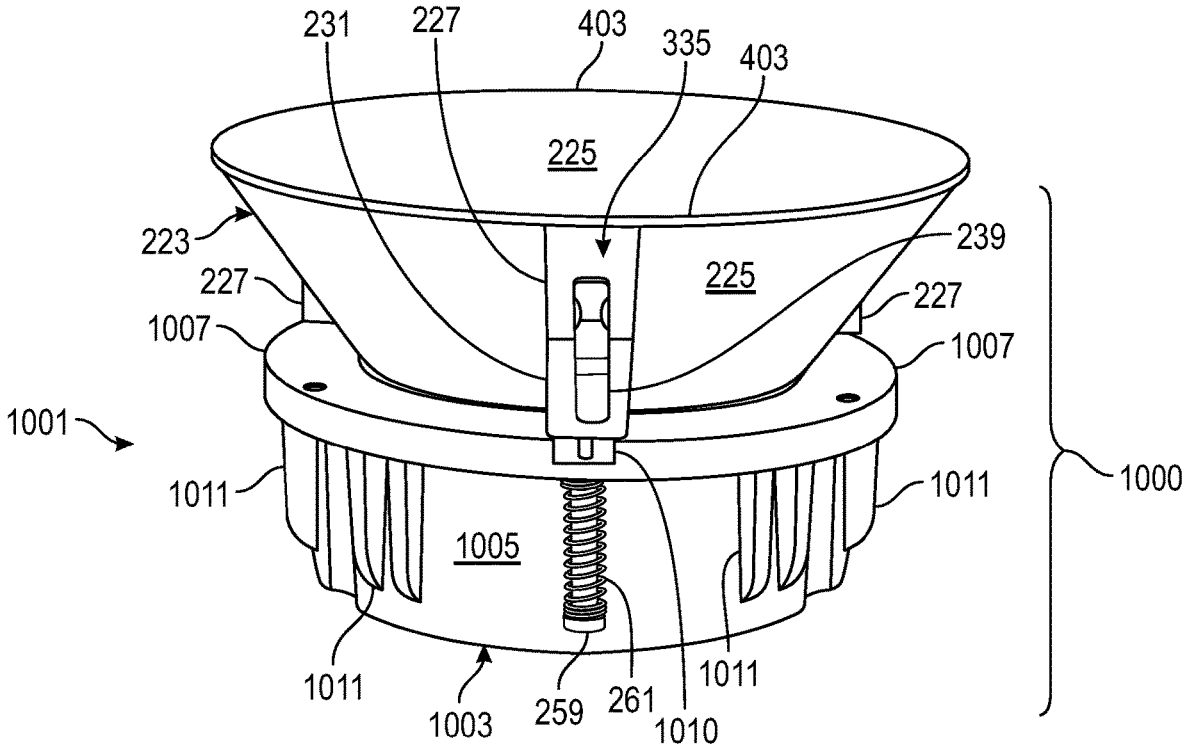
FIG. 10E shows the reflector-and-light-module-subassembly of FIG. 10A from a bottom perspective view.
Figure 10F:
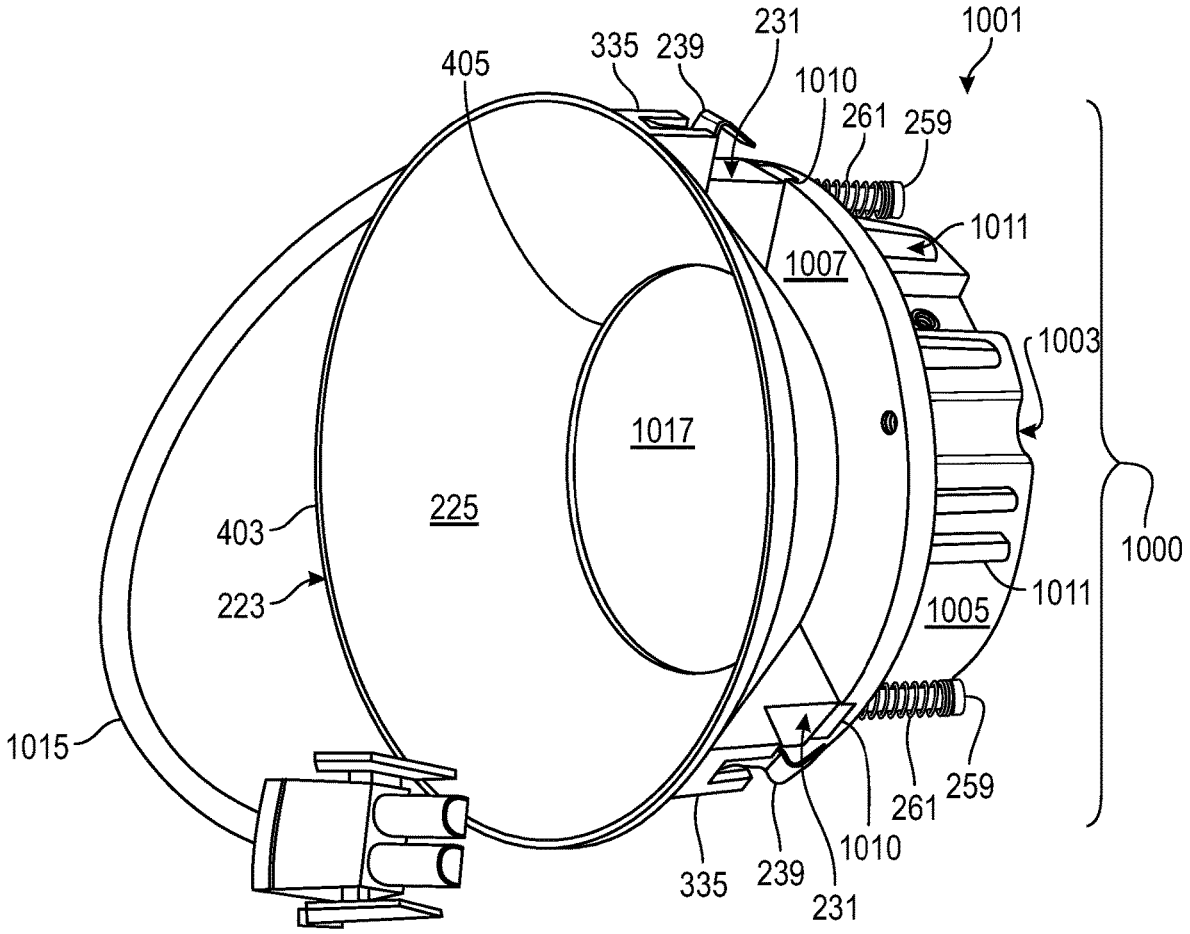
FIG. 10F shows the reflector-and-light-module-subassembly of FIG. 10A from another bottom perspective view.

FIG. 10A depicts a reflector-and-light-module-subassembly 1000 that does not use (include) an intermediary holding-plate 241 (mounting-plate 241) disposed between the reflector 223 and the lighting module 1001, shown from a top perspective view. FIG. 10B shows reflector-and-light-module-subassembly 1000 from another top perspective view. FIG. 10C shows reflector-and-light-module-subassembly 1000 from a side or a rear view. FIG. 10D shows reflector-and-light-module-subassembly 1000 from a slight bottom perspective view. FIG. 10E shows reflector-and-light-module-subassembly 1000 from a bottom perspective view (note shows reflector-and-light-module-subassembly 1000 is shown upside down in FIG. 10E, i.e., with the bottom portion of reflector-and-light-module-subassembly 1000 closer to the figure's header than the top portion). FIG. 10F shows reflector-and-light-module-subassembly 1000 from another bottom perspective view. In some embodiments, reflector-and-light-module-subassembly 1000 may comprise at least one reflector 223 and at least one lighting module 1001, but no holding-plate 241 (mounting-plate 241). In some embodiments, reflector-and-light-module-subassembly 1000 may comprise at least one reflector 223 and at least one lighting module 1001, at least one mechanical fastener 259, and at least one spring 261—but no holding-plate 241 (mounting-plate 241). In some embodiments, lighting module 1001 may have some similar structures and/or geometry as that of holding-plate 241, to enable attachment of lighting module 1001 to reflector 223 in a similar fashion as holding-plate 241 may be attached to reflector 223. In some embodiments, reflector 223 of reflector-and-light-module-subassembly 1000 may be the same reflector 223 as in flangeless trim assembly 200. For example, reflector 223 of reflector-and-light-module-subassembly 1000 may be removably attached to spackle-frame 201 just as reflector 223 of flangeless trim assembly 200 may be removably attached to spackle-frame 201 as described above.

In some embodiments, lighting module 1001 may comprise driver-cap-and/or-heat-sink 1003. In some embodiments, driver-cap-and/or-heat-sink 1003 may function substantially similarly to heat sink module 501 and/or to driver cap 503. In some embodiments, driver-cap-and/or-heat-sink 1003 may have heat sink functionality and/or LED (light emitting diode) electronics driver functionality. In some embodiments, driver-cap-and/or-heat-sink 1003 may be housed within a substantially cylindrical member with substantially cylindrical side-wall 1005. In some embodiments, driver-cap-and/or-heat-sink 1003 and/or side-wall 1005 may have a flanged-base 1007 at a bottom of driver-cap-and/or-heat-sink 1003 and/or at a bottom of side-wall 1005. In some embodiments, flanged-base 1007 may be an annular flange member of driver-cap-and/or-heat-sink 1003 and located at a bottom of driver-cap-and/or-heat-sink 1003. In some embodiments, flanged-base 1007 may have an outside diameter that is greater than an outside diameter of side-wall 1005. In some embodiments, flanged-base 1007 may be substantially similar to flange 253, in terms of function, purpose, structure, and/or geometry. See e.g., FIG. 10A through and including FIG. 10F.

In some embodiments, flanged-base 1007 may comprise one or more receiving-aperture(s) 1009. In some embodiments, receiving-aperture 1009 may be a through-hole that passes entirely through flanged-base 1007. In some embodiments, flanged-base 1007 may comprise a quantity of receiving-aperture(s) 1009 that corresponds to a quantity of: protrusion-of-side-wall(s) 227 (stepped-protrusion(s) 227) in reflector 223 and/or mechanical fastener(s) 259. In some embodiments, receiving-aperture 1009 may be configured to receive a portion (e.g., shaft portion) of a given mechanical fastener 259. In some embodiments, flanged-base 1007 may comprise one or more indenture(s) 1010. In some embodiments, indenture 1010 may be located on a bottom side of flanged-base 1007 and proximate, next to, and/or adjacent to each receiving-aperture 1009 (e.g., within a half-inch of a given receiving-aperture 1009). In some embodiments, receiving-aperture 1009 may also pass through a portion of indenture 1010. In some embodiments, indenture 1010 may be an indentation, indenture, and/or cutout into an underside portion of flanged-base 1007. In some embodiments, a height of indenture 1010 may be less than a thickness/height of flanged-base 1007. In some embodiments, indenture 1010 may have a width that is sized to fit a top portion of top-stepped-face 231 of stepped-protrusion 227, as in a tongue and groove fit. In some embodiments, indenture 1010 may have a width that is sized to fit a top portion of stepped-protrusion 227, as in a tongue and groove fit. In some embodiments, indenture 1010 may be configured to assist and/or to facilitate fitment and/or attachment of flanged-base 1007 to reflector 223. See e.g., FIG. 10A through and including FIG. 10F.

In some embodiments, side-wall 1005 may comprise one or more fin(s) 1011. In some embodiments, fin(s) 1011 may be protrusions/extensions extending outwardly from an exterior surface of side-wall 1005. In some embodiments, fin(s) 1011 may be configured to dissipate and/or radiate heat away from fin(s) 1011 and/or from driver-cap-and/or-heat-sink 1003. In some embodiments, fin(s) 1011 may be configured to dissipate and/or radiate heat away electronics of lighting module 1001. In some embodiments, driver-cap-and/or-heat-sink 1003 may be substantially closed on top 1013 of driver-cap-and/or-heat-sink 1003. In some embodiments, top 1013 and flanged-base 1007 may be oppositely disposed from each other on driver-cap-and/or-heat-sink 1003, separated from each other by a height of side-wall 1005. See e.g., FIG. 10A through and including FIG. 10F.

In some embodiments, lighting module 1001 and/or driver-cap-and/or-heat-sink 1003 may comprise at least one cable 1015. In some embodiments, cable 1015 may extend out from side-wall 1005 and/or from top 1013. In some embodiments, cable 1015 may be configured to bring in electricity (from an exterior source) to lighting module 1001 and/or to driver-cap-and/or-heat-sink 1003. In some embodiments, lighting module 1001 and/or driver-cap-and/or-heat-sink 1003 may comprise at least one lens 1017.

In some embodiments, at least one lens 1017 may be located at least mostly inside of lighting module 1001 and/or of driver-cap-and/or-heat-sink 1003.

In some embodiments, at least one lens 1017 may be located at least mostly inside of and/or at least mostly surrounded by side-wall 1005.

In some embodiments, lens 1017 may comprise a LED chip and/or the like. In reflector-and-light-module-subassembly 1000, at least some portions of bottom exterior of lens 1017 may be visible from below reflector 223. In some embodiments, lens 1017 may be substantially similar to lens 505. See e.g., FIG. 10A through and including FIG. 10F.

In some embodiments, reflector-and-light-module-subassembly 1000 may comprise a quantity of mechanical fastener(s) 259 that may correspond to a quantity of protrusion-of-side-wall(s) 227 (stepped-protrusion(s) 227) in reflector 223. In some embodiments, reflector-and-light-module-subassembly 1000 may comprise a quantity of spring(s) 261 that may correspond to a quantity of mechanical fastener(s) 259. In some embodiments, a given spring 261 may be disposed/trapped between a head of mechanical fastener 259 and a top of flanged-base 1007; and with the shaft portion of that mechanical fastener 259 being disposed within the hollow middle of the given spring 261. In some embodiments, when the spring forces of the spring(s) 261 are not being overcome, a bottom of flanged-base 1007 may rest on top of and in direct physical contact with of the top of reflector 223 (and this may be the default resting configuration for reflector-and-light-module-subassembly 1000). In some embodiments, when the spring forces of the spring(s) 261 are being overcome, a bottom of flanged-base 1007 may be separated by a formed gap (similar to gap 601) from the top of reflector 223; and human finger(s) 801 may be inserted into this gap so that the top of the reflector 223 may be gripped by the human finger(s) 801 and the entirety of reflector-and-light-module-subassembly 1000 may be moved down out of spackle-frame 201. See e.g., FIG. 10A through and including FIG. 10F and replace holding-plate 241 in FIG. 6 with lighting module 1001.

Some embodiments of the present invention may be a lighting system. In some embodiments, a lighting system may comprise flangeless trim assembly 200 and lighting module assembly 500. In some embodiments, a lighting system may comprise trim 331 and lighting module assembly 500. In some embodiments, a lighting system may comprise spackle-frame 201, trim 331, and lighting module assembly 500. In some embodiments, a lighting system may comprise spackle-frame 201 and trim 331. In some embodiments, a lighting system may comprise reflector-and-light-module-subassembly 1000. In some embodiments, a lighting system may comprise spackle-frame 201 and reflector-and-light-module-subassembly 1000.

In some embodiments, a trim, a flangeless trim, flangeless trim assembly 200, and/or the like, may be configured for use in downlight scenarios/applications. In some embodiments, the trim, the flangeless trim, flangeless trim assembly 200, and/or the like may comprise reflector 223 and holding-plate 241.

In some embodiments, holding-plate 241 may be attached to reflector 223. In some embodiments, holding-plate 241 may be configured to attach to lighting module 500. In some embodiments, holding-plate 241 may comprise cylindrical-side-wall 243 that is attached to flange 253. In some embodiments, cylindrical-side-wall 243 may comprise first means for attaching to lighting module 500. In some embodiments, flange 253 may comprise second means for attaching to reflector 223. See e.g., FIG. 2A through FIG. 3B and FIG. 5.

In some embodiments, the first means may be aperture 247 that may be located on cylindrical-side-wall 243. In some embodiments, aperture 247 may run entirely through a portion of cylindrical-side-wall 243. In some embodiments, aperture 247 may be configured to receive a portion of set-fastener 507. In some embodiments, set-fastener 507 may be configured for frictionally engaging a portion of lighting module 500 such that lighting module 500 may be attached to holding-plate 241. See e.g., FIG. 5.

In some embodiments, wherein the second means may be aperture 255 that may be located on the flange 253. In some embodiments, may run entirely through a portion of the flange 253. In some embodiments, aperture 255 may be configured to receive a portion of fastener 259. In some embodiments, fastener 259 may be configured for securing the flange 253 (of holding-plate 241) to reflector 223. In some embodiments, the trim, the flangeless trim, flangeless trim assembly 200, and/or the like may comprise fastener 259. In some embodiments, fastener may be configured to attach holding-plate 241 to reflector 223 by a portion of fastener 259 running through the second means and a different portion of fastener 259 attaching to reflector 223. In some embodiments, a quantity of fastener 259, aperture 255, and a quantity of the stepped-protrusion 227 may match each other. In some embodiments, fastener 259 may comprise a head, a shaft, and a distal-end. In some embodiments, a diameter of the head may be bigger than a diameter of the shaft. In some embodiments, the shaft links the head to the distal-end. In some embodiments, at least a portion of the shaft and/or of the distal-end comprises outside threading. In some embodiments, the portion of fastener 259 that may run through the second means may be a portion of the shaft. In some embodiments, the different portion of fastener 259 that may attach to reflector 223 (e.g., at aperture 333) may be the distal-end of fastener 259. See e.g., FIG. 2A through FIG. 4G.

In some embodiments, when reflector 223 may be attached to holding-plate 241 by fastener(s) 259, linear sliding movement between reflector 223 and holding-plate 241 along at least some length of fastener(s) 259 may be permitted. See e.g., FIG. 6 through FIG. 8.

In some embodiments, the trim, the flangeless trim, flangeless trim assembly 200, and/or the like may comprise helical spring(s) 261. In some embodiments, helical spring 261 may be located around the shaft of a given fastener 259 and disposed between the head of the given fastener 259 and the top of reflector 223. In some embodiments, a force of helical spring(s) 261 may cause the bottom of holding-plate 241 (e.g., the bottom of flange 253) to butt up against the top of reflector 223. See e.g., FIG. 2A through FIG. 3B.

In some embodiments, when an opposing force, that opposes the force of helical spring(s) 261, may be applied to helical spring(s) 261 and may be stronger than the force of helical spring(s) 261, then reflector 223 may separate from the holding-plate 241, by (variable) gap 601, along at least some length of fastener(s) 259, but while the holding-plate 241 remains attached to reflector 223. This opposing force may be imparted by one or more human fingers. See e.g., FIG. 6 through FIG. 8.

In some embodiments, lens 505 and/or lens 1017 may be able to be articulated, rotated, swiveled, portions thereof, combinations thereof, and/or the like with respect to one or more of: reflector 223, heat sink module 501, driver cap 503, lighting module 1001, driver-cap-and/or-heat-sink 1003, portions thereof, combinations thereof, and/or the like.

In some embodiments, the reflector (e.g., reflector 223) may have more of a cylindrical side-wall than a conical frustum shaped side-wall; and in such embodiments, the top-opening may be about the same size as the bottom-opening to that substantially shaped cylindrical side-walled reflector.

In some embodiments, at least some of the parts, components, structures, geometries, and/or the like, of flangeless trim assembly 200 and/or of reflector-and-light-module-subassembly 1000, aside from clips 239 and springs 261, may be one or more of: rigid, substantially rigid, painted, powder coated, made at least substantially of metal, made at least substantially of plastic, made at least substantially of ceramic, made at least substantially of wood, made at least substantially of composites, portions thereof, combinations thereof, and/or the like.

Note, no humans nor portions thereof are claimed. And claims should not be interpreted to claiming a human or a portion thereof. However, humans may use the embodiments disclosed and discussed herein. And the embodiments disclosed and discussed herein may be configured for use by humans or portions thereof.

Downlight trim, flangeless trim, flangeless trim assemblies, lighting modules, and lighting systems have been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching without departing from the spirit of the invention.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A reflector configured for use in a ceiling downlight assembly, wherein the reflector comprises:

a side-wall that forms a conical frustum shape that is hollow, with a smaller-top-opening defining a top of the reflector and a larger-bottom-opening defining a bottom of the reflector; wherein the smaller-top-opening and the larger-bottom-opening are disposed opposite from each other with the side-wall located between the smaller-top-opening and the larger-bottom-opening;

a stepped-protrusion that extends out of an exterior of the side-wall, in an upward direction from the bottom of the reflector and in a radial direction outwards away from the exterior of the side-wall; wherein the stepped-protrusion has two different faces that occupy different planes from each other, wherein the different planes are both perpendicular to a radial direction; wherein the radial direction is from outwards in a linear line from a longitudinal center of the reflector.

2. The reflector according to claim 1, wherein a diameter of the smaller-top-opening is smaller than a diameter of the larger-top-opening.

3. The reflector according to claim 1, wherein the two different faces are a top-stepped-face and a bottom-stepped-face; wherein the top-stepped-face is located above the bottom-stepped-face; wherein the top-stepped-face is located closer to the smaller-top-opening than the bottom-stepped-face; wherein bottom-stepped-face is located closer to the larger-bottom-opening than the top-stepped-face.

4. The reflector according to claim 3, wherein the top-stepped-face is located closer to the longitudinal center of the reflector than the bottom-stepped-face.

5. The reflector according to claim 3, wherein the bottom-stepped-face comprises a clip-receiver that is configured to house and hold a portion of a clip.

6. The reflector according to claim 5, wherein the bottom-stepped-face comprises the clip, wherein the portion of the clip is housed and held within the clip-receiver.

7. The reflector according to claim 6, wherein a different portion of the clip is configured to removably engage a top-opening of a spackle-frame.

8. The reflector according to claim 1, wherein the stepped-protrusion comprises a top surface; wherein the top surface comprises an aperture, wherein the aperture is configured to receive a distal portion of a fastener.

9. The reflector according to claim 1, wherein the stepped-protrusion is present in a quantity of three distinct stepped-protrusions, wherein these stepped-protrusions are spaced apart equally from each other by 120 degrees.

10. A trim configured for use in a ceiling downlight assembly, wherein the trim comprises:

a reflector that is configured to reflect light from an underside of the reflector, wherein the reflector comprises:

a side-wall that forms a conical frustum shape that is hollow, with a smaller-top-opening defining a top of the reflector and a larger-bottom-opening defining a bottom of the reflector; wherein the smaller-top-opening and the larger-bottom-opening are disposed opposite from each other with the side-wall located between the smaller-top-opening and the larger-bottom-opening;

a stepped-protrusion that extends out of an exterior of the side-wall, in an upward direction from the bottom of the reflector and in a radial direction outwards away from the exterior of the side-wall; wherein the stepped-protrusion has two different faces that occupy different planes from each other, wherein the different planes are both perpendicular to a radial direction; wherein the radial direction is a linear line moving outwards from a longitudinal center of the reflector;

a holding-plate that is attached to the reflector; wherein the holding-plate is configured to attach to a lighting module; wherein the holding-plate comprises a cylindrical-side-wall that is attached to a flange; wherein the cylindrical-side-wall comprises first means for attaching to the lighting module; wherein the flange comprises second means for attaching to the reflector.

11. The trim according to claim 10, wherein the first means is an aperture that is located on the cylindrical-side-wall and that runs entirely through a portion of the cylindrical-side-wall, wherein the aperture is configured to receive a portion of a set-fastener, wherein the set-fastener is configured for frictionally engaging a portion of the lighting module such that the lighting module is attached to the holding-plate.

12. The trim according to claim 10, wherein the second means is an aperture that is located on the flange and that runs entirely through a portion of the flange, wherein the aperture is configured to receive a portion of a fastener, wherein the fastener is configured for securing the flange to the reflector.

13. The trim according to claim 12, wherein the trim further comprises the fastener.

14. The trim according to claim 10, wherein the trim further comprises a fastener; wherein the fastener is configured to attach the holding-plate to the reflector by a portion of the fastener running through the second means and a different portion of the fastener attaching to the reflector.

15. The trim according to claim 14, wherein a quantity of the fastener and a quantity of the stepped-protrusion match each other.

16. The trim according to claim 14, wherein the fastener comprises a head, a shaft, and a distal-end; wherein the shaft links the head to the distal-end; wherein the portion of the fastener that runs through the second means is a portion of the shaft; wherein the different portion of the fastener that attaches to the reflector is the distal-end.

17. The trim according to claim 16, wherein when the reflector is attached to the holding-plate by the fastener, movement between the reflector and the holding-plate along at least some length of the fastener is permitted.

18. The trim according to claim 16, wherein the trim comprises a helical spring, wherein the helical spring is located around the shaft and disposed between the head and the top of the reflector.

19. The trim according to claim 18, wherein a force of the helical spring causes a bottom of the holding-plate to butt up against the top of the reflector.

20. The trim according to claim 19, wherein when an opposing force that opposes the force of the helical spring is applied to the helical spring and is stronger than the force of the helical spring, then the reflector separates from the holding-plate, by a gap, along at least some length of the fastener, but while the holding-plate remains attached to the reflector.

* * * * *